US008012909B2

(12) United States Patent
Hosokawa et al.

(10) Patent No.: US 8,012,909 B2
(45) Date of Patent: Sep. 6, 2011

(54) HEAT-SENSITIVE TRANSFER IMAGE-FORMING METHOD

(75) Inventors: Junichiro Hosokawa, Minami-ashigara (JP); Shin Soejima, Haibara-gun (JP); Hidekazu Sakai, Minami-ashigara (JP); Kazuaki Oguma, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 833 days.

(21) Appl. No.: 12/056,138

(22) Filed: Mar. 26, 2008

(65) Prior Publication Data

US 2008/0254981 A1 Oct. 16, 2008

(30) Foreign Application Priority Data

Mar. 27, 2007 (JP) ..... 2007-080763

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

FOREIGN PATENT DOCUMENTS

EP 1 364 808 A2 11/2003
JP 5-286268 A 11/1993

*Primary Examiner* — Bruce H Hess
(74) *Attorney, Agent, or Firm* — Sughrue Mion, PLLC

(57) ABSTRACT

An heat-sensitive transfer image-forming method which uses a heat-sensitive transfer image-receiving sheet and a heat-sensitive transfer sheet, in which the heat-sensitive transfer image-receiving sheet includes at least one receptor layer; and the heat-sensitive transfer sheet includes at least one yellow dye layer, at least one magenta dye layer, and at least one cyan dye layer: the method including superposing the heat-sensitive transfer sheet on the heat-sensitive transfer image-receiving sheet, and then heating to form an image on the receptor layer; and controlling the maximum value of E value represented by formula (1) having the range from 52 to 72, based on a* value and b* value in the region of L* value of the formed magenta monochromatic image ranging from 45 to 90: Formula (1) $E=\sqrt{(a^{*2}+b^{*2})}$.

4 Claims, 2 Drawing Sheets

HEAT-SENSITIVE TRANSFER IMAGE-FORMING METHOD

FIELD OF THE INVENTION

The present invention relates to a heat-sensitive transfer image forming method. In particular, the present invention relates to a heat-sensitive transfer image forming method for obtaining faithful and natural color reproduction that is close to the original and has no felling of unnaturalness.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities. Therefore, the thus-obtained image is excellent in middle tone reproduction and gradation representation, and thereby an extremely high-definition image can be obtained.

Further, such the dye diffusion transfer recording system has such merits that image formation can be performed in a dry state, an image can be visualized directly from digital data, and copying is simple, and therefore said recording system is widening its market as a full color hard copy system.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

SUMMARY OF THE INVENTION

The present invention resides in a heat-sensitive transfer image-forming method which uses a heat-sensitive transfer image-receiving sheet and a heat-sensitive transfer sheet, in which the heat-sensitive transfer image-receiving sheet comprises at least one receptor layer; and the heat-sensitive transfer sheet comprises at least one yellow dye layer, at least one magenta dye layer, and at least one cyan dye layer:

comprising superposing the heat-sensitive transfer sheet on the heat-sensitive transfer image-receiving sheet, and then heating to form an image on the receptor layer; and comprising controlling the maximum value of E value represented by formula (1) having the range from 52 to 72, based on a* value and b* value in the region of L* value of the formed magenta monochromatic image ranging from 45 to 90.

$$E=\sqrt{(a^{*2}+b^{*2})} \qquad \text{Formula (1)}$$

Other and further features and advantages of the invention will appear more fully from the following description, appropriately referring to the accompanying drawings.

DETAILED DESCRIPTION OF THE INVENTION

Figure 1:
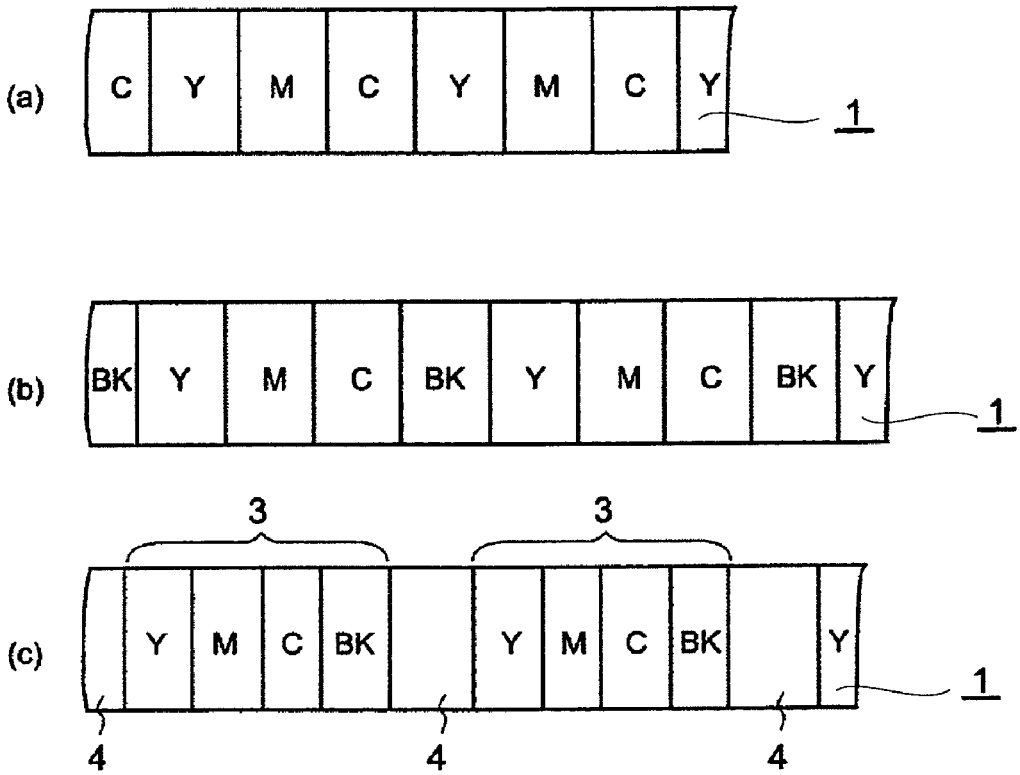
FIG. 1(*a*) to FIG. 1(*c*) are plane figures showing one embodiment of the heat-sensitive transfer sheet (ink sheet).

There is a high demand for properties to dyes that are used in a heat-sensitive transfer sheet. For example, the dyes are required to satisfy the following properties: transfer property of the dye from the heat-sensitive transfer sheet to an image-receiving layer (a receptor layer) is so high that a color image having high density can be obtained; the dyes are stable to light, heat and the like and therefore they are excellent in resistance to fading; and there is little possibility of color-edge definition loss due to diffusion of dye image in the lapse of time after transfer of the dyes to the image-receiving layer.

In addition, when various kinds of colors are reproduced in an image, a hue of the dye also becomes important. When a structure of the dye is selected from the view point of the requirements for the above-described transfer property, resistance to fading, stability and so on, such a structure is not always an optimum structure selected from the view point of the dye hue. In this case, a tradeoff (bargaining) may arise between the color hue of dye and the above-described transfer property, resistance to fading, and stability. As a result, it causes a problem that image quality and color reproduction can not be achieved together. Especially, various kinds of intermediate colors exist in the nature world, and colors of a majority of substances contain muddiness (turbidity). Therefore, it is an important and very difficult problem that these colors can be reproduced in an image to form a finished print which has no feeling of unnaturalness compared to the original.

With respect to colorimetry, a general ides of uniform color space known as CIELAB can be used. The samples are mathematically analyzed using a spectrophotometric curve, properties of a light source under which the samples are measured, and color visual sensation of a standard observer. As to the CIELAB and colorimetry, there are described in *Principles of Color Technology*, authored by F. W. Billmeyer, 2nd Edition, Wily Interscience, pp. 25 to 100, and *Optical Radiation Measurements*, authored by F. Gram, Vol. 2, Academic Press, pp. 33 to 145.

When the CIELAB is used, the color is indicated by 3 parameters, i.e., L*, a* and b*. Herein, L* is a function of lightness, and both a* and b* define points in the color space. Thus, with respect to a certain color sample, a plot of a* value to b*value is used to accurately indicate where the sample exists in the color space, namely what a color hue of the sample is. The use of the CIELAB enables to independently compare lightness and color hue in each sample, respectively.

In JP-A-2003-335071 ("JP-A" means unexamined published Japanese patent application), there is described a heat-sensitive transfer image forming element using RMS error value that is defined by a difference between the obtained image and a target color in terms of intensity in each wavelength of the spectral curve. In this method of using a RMS error value, it is possible to bring various colors close to the original color in terms of characteristic values, but it is found that such the method is not sufficient to gain the finished image having no feeling of unnaturalness. It is supposed that this is because only a gap of density in each wavelength is simply evaluated in the RMS error value making no discrimination of the wavelength and without taking a direction of the gap into consideration, so that evaluation is performed equally in both increasing and decreasing directions of saturation.

As a result of intensive studies, it is found that a print, which has an image portion having much higher saturation than the original color, gives a strongly impression with feeling of unnaturalness in view of color reproduction. Further, it is also found that, when saturation of a magenta family color is too high, a print gives a strongly impression with feeling of unnaturalness because the magenta family color has a high visual sensitivity.

As a result of eager study, the present inventors have found the above-described objects can be achieved by the following means:

The present invention provides the following means:

(1) An heat-sensitive transfer image-forming method which uses a heat-sensitive transfer image-receiving sheet and a heat-sensitive transfer sheet, in which the heat-sensitive transfer image-receiving sheet comprises at least one receptor layer; and the heat-sensitive transfer sheet comprises at least one yellow dye layer, at least one magenta dye layer, and at least one cyan dye layer:

comprising superposing the heat-sensitive transfer sheet on the heat-sensitive transfer image-receiving sheet, and then heating to form an image on the receptor layer; and comprising controlling the maximum value of E value represented by formula (1) having the range from 52 to 72, based on a* value and b* value in the region of L* value of the formed magenta monochromatic image ranging from 45 to 90.

$$E=\sqrt{(a^{*2}+b^{*2})} \quad \text{Formula (1)}$$

(2) The heat-sensitive transfer image-forming method as described in item (1), wherein the magenta dye layer contains at least one cyan dye in a content of 2% by mass to 10% by mass.

(3) The heat-sensitive transfer image forming method as described in item (2), wherein the magenta dye layer contains at least one magenta dye represented by formula (M) and the cyan dye is a cyan dye represented by formula (C1):

Formula (M)

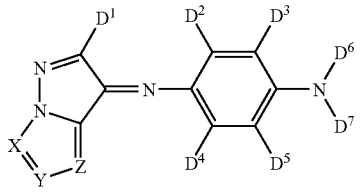

wherein, in formula (M), $D^1$, $D^2$, $D^3$ $D^4$, and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$- or a nitrogen atom, in which $D^8$ represents a hydrogen atom, an alkyl group, an aryl group, an alkoxy group, an aryloxy group, or an amino group; when X and Y each represent $=C(D^8)$- or Y and Z each represent $=C(D^8)$-, two $D^8$s may be bonded together to form a saturated or unsaturated carbon ring; and each of the above-mentioned groups may further be substituted, and Formula (C1)

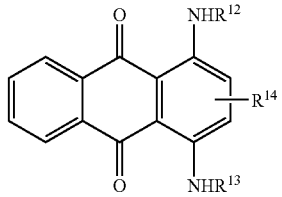

wherein, in formula (C1), $R^{12}$ and $R^{13}$ each independently represent a substituted or unsubstituted alkyl group or a substituted or unsubstituted aryl group; and $R^{14}$ represents a hydrogen atom or a substituent.

(4) The heat-sensitive transfer image forming method as described in item (2), wherein the magenta dye layer contains at least one magenta dye represented by formula (M) and the cyan dye is a cyan dye represented by formula (C2):

Formula (M)

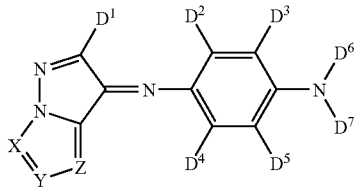

wherein, in formula (M), $D^1$, $D^2$, $D^3$ $D^4$, and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$- or a nitrogen atom, in which $D^8$ represents a hydrogen atom, an alkyl group, an aryl group, an alkoxy group, an aryloxy group, or an amino group; when X and Y each represent $=C(D^8)$- or Y and Z each represent $=C(D^8)$, two $D^8$s may be bonded together to form a saturated or unsaturated carbon ring; and each of the above-mentioned groups may further be substituted, and Formula (C2)

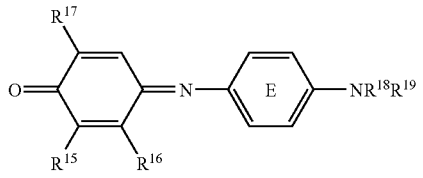

wherein, in formula (C2), the ring E represents a substituted or unsubstituted benzene ring; $R^{15}$ represents a hydrogen atom or a halogen atom; $R^{16}$ represents a substituted or unsubstituted alkyl group; $R^{17}$ represents a substituted or unsubstituted acylamino group or a substituted or unsubstituted alkoxycarbonylamino group; and $R^{18}$ and $R^{19}$ each independently represent a substituted or unsubstituted alkyl group, a substituted or unsubstituted alkenyl group, or a substituted or unsubstituted aryl group.

The heat-sensitive transfer sheet that is used in the present invention has at least one dye layer (heat transfer layer) containing at least one dye disposed on one surface of a support. The dye layer (heat transfer layer) may be a single layer constitution, or a multilayer constitution. In the case of multilayer constitution, a composition of each dye layer may be the same or different from each other.

Dye layers each having different dye may be separately coated with repetition in area order on the same support, or alternatively each dye layer may be formed on each individual support.

The term "forming layers in area order" as used in the present specification means forming dye layers each having a different hue and/or function layers in the longitudinal direction on the support of the heat-sensitive transfer sheet, by applying them separately in order.

Examples include the case in which a yellow dye layer, a magenta dye layer, and a cyan dye layer are formed in this order in the longitudinal direction on the support.

Further, any arrangement of these dye layers can be employed, but it is preferred that a yellow dye layer, a magenta dye layer, and a cyan dye layer be arranged sequentially in this order on the support.

Arrangement of the dye layers of different hues in the present invention is not limited to the above, and a black or other dye layer of a hue other than yellow, magenta, and cyan can be employed as required. Further, it is preferred to form a transferable protective layer (a transferable protective layer laminate) as a function layer, after forming the yellow dye layer, the magenta dye layer, and the cyan dye layer in the longitudinal direction on the support, as mentioned above.

Next, the present invention is explained in detail with reference to drawings. However, the present invention is not limited to these embodiments.

Figure 2:
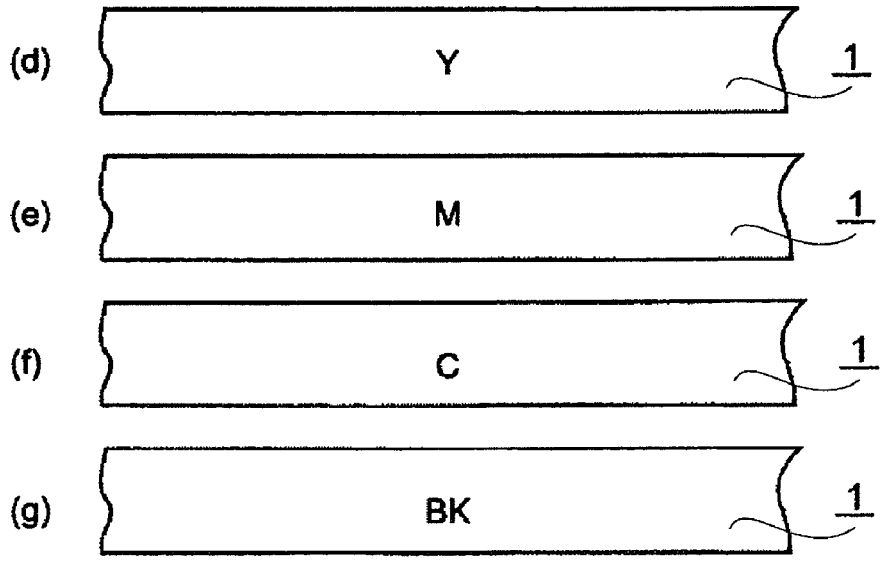
FIG. 2 is a plane figure showing one embodiment of the heat-sensitive transfer sheet in which each heat transfer layer (dye layer) is formed on a separate support, respectively.
Figure 3:
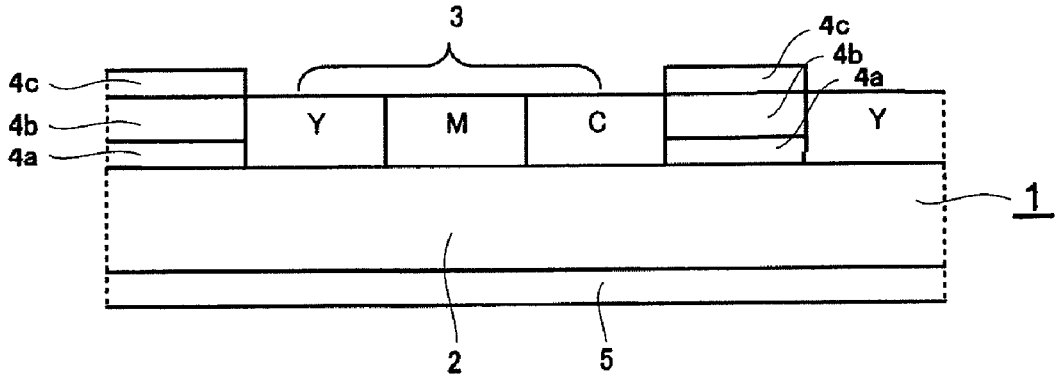
FIG. 3 is a cross-sectional view showing one embodiment of the heat-sensitive transfer sheet.

In FIGS. 1 to 3, FIG. 1 stands for a heat-sensitive transfer sheet.

FIGS. 1(*a*) to 1(*c*) are plan views each of which shows one embodiment of the heat-sensitive transfer sheet that is used in the present invention. As an example, in FIG. 1(*a*) there is shown the embodiment wherein dye ink layers Y, M and C with each of hues of yellow, magenta and cyan are separately coated in area order. It is preferred to dispose heat transfer layers with each of hues in area order on the same support as shown in FIG. 1(*a*). Further, it is also a preferable embodiment that either of, or both of a dye ink layer BK with a black hue and a transferable protective layer is (are) separately coated in addition to the aforementioned three layers as illustrated in FIG. 1(*b*). In the case where such the embodiment is employed, it is also a preferable embodiment that a mark is put on the heat-sensitive transfer sheet in order to communicate a starting point of each color to a printer. Such a repeated separate coating in area order enables to complete both an image formation owing to sublimation of a dye and a lamination of a protective layer on the image in the same heat-sensitive transfer sheet. Alternatively, it is also possible to dispose dye layers Y, M, C, and BK with each hue of yellow, magenta, cyan and black all over the surface of each of separate supports. Further, it is also preferred to dispose a transferable protective layer laminate 4 among the dye ink layers 3 that are composed of Y, M, C and BK as illustrated in FIG. 1(*c*).

The present invention is not limited to the arrangement of the dye ink layers as described above. In accordance with necessity, arrangement of the dye ink layers may be arbitrarily changed, for example, by placing both a sublimation type heat transfer ink layer and a hot-melt transfer ink layer, or by disposing an ink layer with a hue other than yellow, magenta, cyan and black.

A form of the heat-sensitive transfer sheet may be a continuous roll sheet or a thin sheet (a cut sheet).

In the present invention, it is necessary that the maximum of the E value that is calculated according to formula (1) is in the range of from 52 to 72, based on a* and b* values, in the region where the L* value of the formed magenta monochromatic image ranges from 45 to 90. It is more preferred that the maximum of the E value ranges from 55 to 68. If the maximum of the E value is too small, color saturation of the image becomes too low, which results in the image without impact. On the other hand, if the maximum of the E value is too large, image portions with too higher color saturation than the original color are formed. Such the image portions are apt to give a feeling of unnaturalness.

Hereinafter, the ink for dye layer for use in the present invention will be explained.

(Ink for Dye Layer)

The ink for dye layer contains at least a sublimation type dye and a binder resin. It is a preferable embodiment of the present invention that the ink may contains organic or inorganic finely divided powder, waxes, silicone resins, and fluorine-containing organic compounds, in accordance with necessity.

The dye for use in the present invention is not particularly limited, so far as the dye is able to diffuse by heat and/or able to be incorporated in a sublimation type heat-sensitive transfer sheet, and able to transfer by heat from the sublimation type heat-sensitive transfer sheet to a heat-sensitive transfer image-receiving sheet. Accordingly, as the dye that is used for the heat-sensitive transfer sheet, ordinarily used dyes or known dyes can be effectively used.

Examples of the dye include diarylmethane-series dyes; triarylmethane-series dyes; thazole-series dyes; methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thazine-series dyes; azine-series dyes; acridine-series dyes; benzene azo-series dyes; azo-series dye such as pyridone azo, thiophene azo, isothiazole azo, pyrol azo, pyral azo, imidazole azo, thiadiazole azo, triazole azo, disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

Dyes that can be preferably used in the present invention are explained in detail below.

In the heat transfer layer (hereinafter, also referred to as the dye layer) of the ink sheet that is used in the present invention, use can be made of dyes that have been usually employed as a yellow dye. Among these, at least one dye represented by any one of formulae (Y1) and (Y2) is preferably contained in the heat transfer layer. However, the yellow dye that can be used in the present invention is not limited to these dyes.

First, the dye represented by formula (Y1) is explained in detail below.

Formula (Y1)

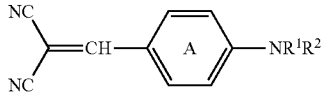

In formula (Y1), the ring A represents a substituted or unsubstituted benzene ring; and $R^1$ and $R^2$ each independently represent a hydrogen atom, a substituted or unsubstituted alkyl group, a substituted or unsubstituted alkenyl group or a substituted or unsubstituted aryl group.

Each of the groups represented by $R^1$ and $R^2$ may further have a substituent. Examples of a substituent by which the ring A, $R^1$ and $R^2$ each may be substituted include a halogen atom, an unsaturated alkyl group, a cycloalkyl group, an aryl group, a heterocyclic group, an alkoxyl group, an acyloxy group, a carbamoyloxy group, an alkoxycarbonyloxy group, an aryloxycarbonyloxy group, an amino group, an acylamino group, an aminocarbonylamino group, an alkoxycarbonylamino group, a sulfamoylamino group, an alkyl- or arylsulfonylamino group, an alkylthio group, a sulfamoyl group, an alkyl group, an arylsulfinyl group, an arylsulfonyl group, an acyl group, an aryloxycarbonyl group, an alkoxycarbonyl group, a carbamoyl group, an aryl- or heterocyclic-azo group, an imido group, a hydroxyl group, a cyano group, a nitro group, a sulfo group and a carboxyl group.

Examples of a preferred combination of the substituent in a dye represented by formula (Y1) include combinations wherein the ring A is a substituted or unsubstituted benzene ring; $R^1$ is a substituted or unsubstituted alkyl group having 1 to 8 carbon atoms, an allyl group, or a substituted or unsubstituted aryl group having 6 to 10 carbon atoms; and $R^2$ is a substituted or unsubstituted alkyl group having 1 to 8 carbon atoms, an allyl group, or a substituted or unsubstituted aryl group having 6 to 10 carbon atoms.

In more preferred combinations of the substituent, the ring A is a substituted or unsubstituted benzene ring; $R^1$ is a substituted or unsubstituted alkyl group having 1 to 6 carbon atoms, an allyl group, or a substituted or unsubstituted phenyl group; and $R^2$ is a substituted or unsubstituted alkyl group having 1 to 6 carbon atoms, an allyl group, or a substituted or unsubstituted phenyl group.

In the most preferred combinations, the ring A is a benzene ring substituted by a methyl group; $R^1$ is an unsubstituted alkyl group having 1 to 4 carbon atoms; and $R^2$ is a substituted alkyl group having 1 to 4 carbon atoms. Examples of a group suitable as the substituent by which the alkyl group of $R^2$ may further be substituted include an alkoxy group having 1 to 4 carbon atoms, an aryl group having 6 to 20 carbon atoms, an aryloxy group having 6 to 20 carbon atoms, an alkoxycarbonyl group whose alkoxy moiety contains 1 to 4 carbon atoms, and a substituted or unsubstituted aryloxycarbonyl group whose aryl moiety contains 6 to 20 carbon atoms.

Preferable examples of the dye represented by formula (Y1) are shown below, but the dye that can be used in the present invention are not limited to the following specific examples.

Y1-1

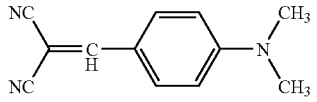

Y1-2

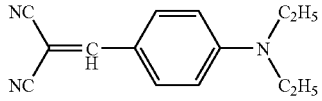

Y1-3

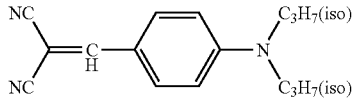

Y1-4

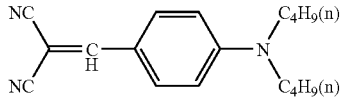

Y1-5

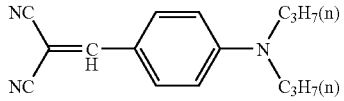

Y1-6

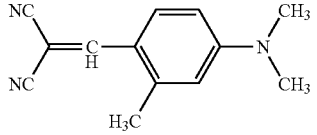

Y1-7

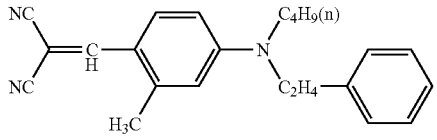

-continued

Y1-8

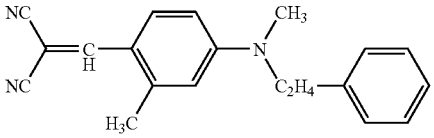

Y1-9

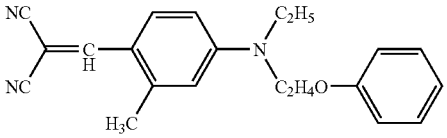

Y1-10

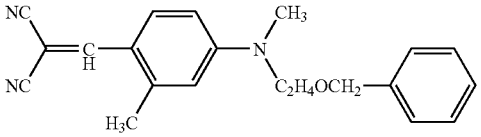

Y1-11

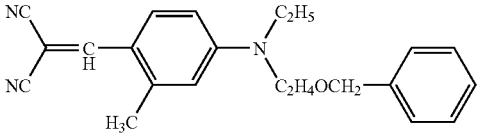

Y1-12

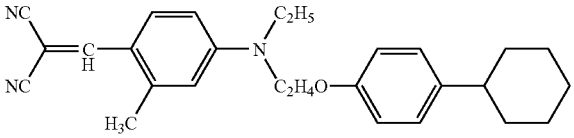

Y1-13

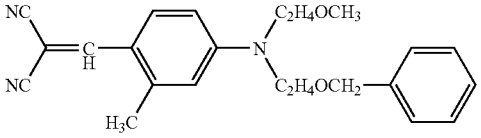

Y1-14

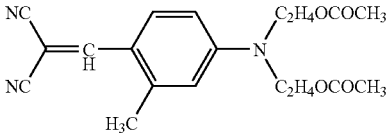

Next, the dye represented by formula (Y2) is explained in detail below.

Formula (Y2)

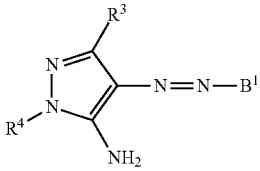

In formula (Y2), $B^1$ represents a substituted or unsubstituted aryl group or a substituted or unsubstituted aromatic heterocyclic group; $R^3$ represents a substituted or unsubstituted alkyl group; and $R^4$ represents a substituted or unsubstituted alkyl group or a substituted or unsubstituted aryl group.

Each group of $R^3$ and $R^4$ may further have a substituent. Examples of a substituent by which each group of $B^1$, $R^3$ and $R^4$ may be substituted include the same substituents as the ring A and each group of $R^1$ and $R^2$ in formula (Y1) described above may have.

The aryl group of $B^1$ is preferably a phenyl group which may have a substituent.

Examples of a preferred combination of the substituents $B^1$, $R^3$ and $R^4$ in a dye represented by formula (Y2) include combinations wherein $B^1$ is a substituted or unsubstituted aryl group having 6 to 10 carbon atoms, a substituted or unsubstituted pyrazolyl group, or a substituted or unsubstituted thiadiazolyl group; $R^3$ is a substituted or unsubstituted alkyl group having 1 to 8 carbon atoms; and $R^4$ is a substituted or unsubstituted aryl group having 6 to 10 carbon atoms.

In more preferred combinations of the substituents, $B^1$ is a substituted or unsubstituted phenyl group, or a substituted or unsubstituted 1,3,4-thiadiazolyl group; $R^3$ is a substituted or unsubstituted alkyl group having 1 to 6 carbon atoms; and $R^4$ is a substituted or unsubstituted alkyl group having 1 to 6 carbon atoms, or a substituted or unsubstituted phenyl group.

In the most preferred combinations of the substituents, $B^1$ is a 4-nitrophenyl group, or a 1,3,4-thiadiazolyl group substituted with a thioalkyl group having 1 to 6 carbon atoms; $R^3$is an unsubstituted alkyl group having 1 to 4 carbon atoms; and $R^4$ is an unsubstituted alkyl group having 1 to 4 carbon atoms, or a substituted or unsubstituted phenyl group. The substituent of the phenyl group of $R^4$ is preferably a 2-chloro group, a 4-chloro group, a 2,4,6-trichloro group, a 4-carboxylmethyl group or a 4-carboxyethyl group.

Preferable examples of the dye represented by formula (Y2) are shown below, but the dyes that can be used in the present invention are not limited to the following specific examples.

Y2-1

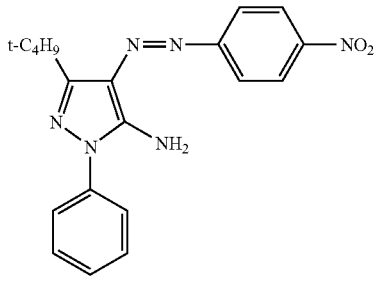

Y2-2

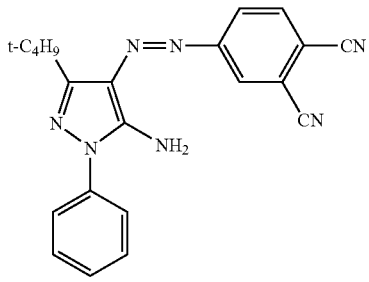

-continued

Y2-3

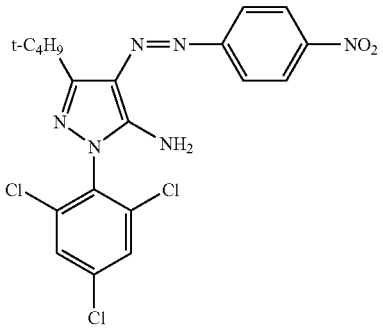

Y2-4

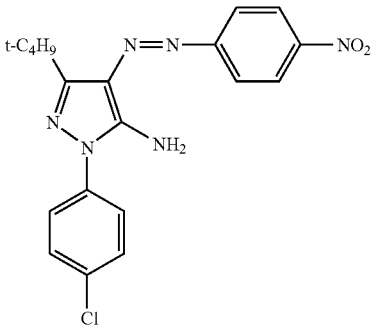

Y2-5

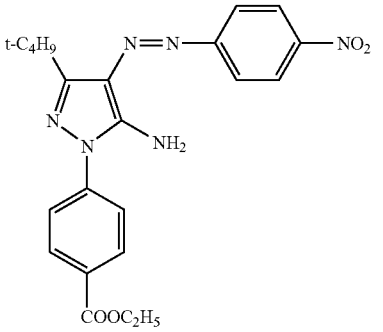

Y2-6

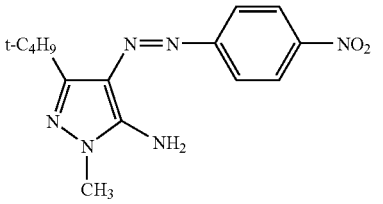

Y2-7

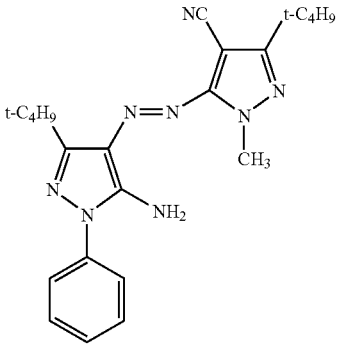

-continued

Y2-8

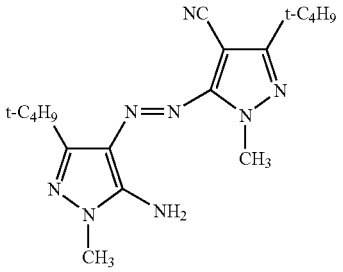

Y2-9

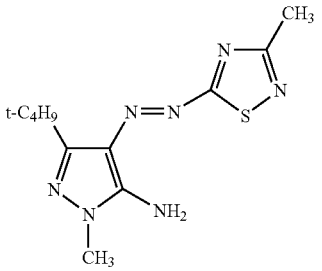

Y2-10

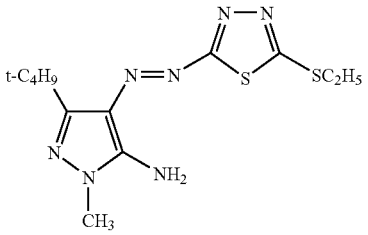

These dyes can be easily synthesized by or according to the method described in JP-A-1-225592.

Next, the dye represented by formula (M) is explained below.

Formula (M)

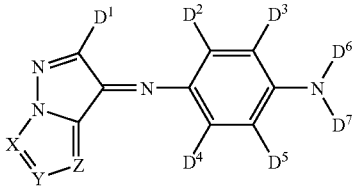

In formula (M), $D^1$, $D^2$, $D^3$ $D^4$, and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$- or a nitrogen atom, in which $D^8$ represents a hydrogen atom, an alkyl group, an aryl group, an alkoxy group, an aryloxy group, or an amino group; when X and Y each represent $=C(D^8)$- or Y and Z each represent $=C(D^8)$-, two $D^8$s may be bonded together to form a saturated or unsaturated carbon ring; and each of the above-mentioned groups may further be substituted.

$D^1$ to $D^5$ each independently represents a hydrogen atom, a halogen atom (e.g., chlorine, bromine, fluorine atom), an alkyl group (those having preferably 1 to 12 carbon atoms such as methyl, ethyl, isopropyl, n-propyl and t-butyl groups), an alkoxy group (those having preferably 1 to 12 carbon atoms such as methoxy, butoxy, octyloxy and dodecyloxy groups), an aryl group (those having preferably 6 to 10 carbon atoms such as phenyl, m-nitrophenyl, p-nitrophenyl, p-tolyl and naphthyl groups), an aryloxy group (those having preferably 6 to 10 carbon atoms such as phenyloxy, m-nitrophenyloxy, p-nitrophenyloxy, p-tolyloxy and naphthyloxy groups), a cyano group, an acylamino group (those having preferably 1 to 12 carbon atoms such as formylamino, acetylamino, butylcarbonylamino and octylcarbonylamino groups), a sulfonylamino group (those having preferably 1 to 12 carbon atoms such as methanesulfonamido, butanesulfonamido, octanesulfonamido, benzene sulfonamido and toluenesulfonamido groups), a ureido group (those having preferably 1 to 12 carbon atoms such as N-methylureido, N,N-dimethylureido, N-phenylureido, N-methyl-N-phenylureido and N-octylureido groups), an alkoxycarbonylamino group (those having preferably 2 to 12 carbon atoms such as methoxycarbonylamino, ethoxycarbonylamino, isopropoxycarbonylamino, and n-octyloxycarbonylamino groups), an alkylthio group (those having preferably 1 to 12 carbon atoms such as methylthio, ethylthio, butylthio, octylthio, isobutylthio and t-octylthio groups), an arylthio group (those having preferably 6 to 10 carbon atoms such as phenylthio and naphthylthio groups), an alkoxycarbonyl group (those having preferably 2 to 12 carbon atoms such as methoxycarbonyl, ethoxycarbonyl, isopropoxycarbonyl and n-octyloxycarbonyl groups), a carbamoyl group (those having preferably 1 to 12 carbon atoms such as N-methylcarbamoyl, N,N-dimethyl carbamoyl, N-phenylcarbamoyl, N-butyl-N-phenylcarbamoyl groups), a sulfamoyl group (those having preferably 1 to 12 carbon atoms such as N-methylsulfamoyl, N-phenylsulfamoyl, N-ethyl-N-phenylsulfamoyl groups), a sulfonyl group (those having preferably 1 to 12 carbon atoms such as methylsulfonyl, butylsulfonyl, benzenesulfonyl and toluenesulfonyl groups), an acyl group (those having preferably 1 to 12 carbon atoms such as formyl, acetyl and lauroyl groups), or an amino group (those having preferably 0 to 12 carbon atoms such as amino, methylamino, phenylamino, N-methyl-N-phenylamino and octylamino groups). $D^6$ and $D^7$ each independently represent a hydrogen atom, an alkyl group (those having preferably 1 to 12 carbon atoms such as methyl, ethyl, isopropyl, n-propyl and t-butyl groups), an alkoxy group (those having preferably 1 to 12 carbon atoms such as methoxy, butoxy, octyloxy and dodecyloxy groups) or an aryl group (those having preferably 6 to 10 carbon atoms such as phenyl, m-nitrophenyl, p-nitrophenyl, p-tolyl and naphthyl groups). $D^6$ and $D^7$ may bond together to form a ring. $D^3$ and $D^6$ or/and $D^5$ and $D^7$ may bond together to form a ring.

X, Y and Z each represents $=C(D^8)$- or a nitrogen atom. $D^8$ represents a hydrogen atom, an alkyl group (those having preferably 1 to 12 carbon atoms such as methyl, ethyl, isopropyl, n-propyl and t-butyl groups), an aryl group (those having preferably 6 to 10 carbon atoms such as phenyl, m-nitrophenyl, p-nitrophenyl, p-tolyl and naphthyl groups), an alkoxy group (those having preferably 1 to 12 carbon atoms such as methoxy, butoxy, octyloxy and dodecyloxy groups), an aryloxy group (those having preferably 6 to 10 carbon atoms such as phenyloxy, m-nitrophenyloxy, p-nitrophenyloxy, p-tolyloxy and naphthyloxy groups), or an amino group (those having preferably 0 to 12 carbon atoms such as amino, methylamino, phenylamino, N-methyl-N-phenylamino and octylamino groups). When X and Y each represents $=C(D^8)$-, or Y and Z each represents $=C(D^8)$-, two $D^8$ 's may bond together to form a saturated or unsaturated carbon ring. Further, each of the aforementioned groups may have a substituent. Examples of the substituent include a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, a heterocyclic group, a sulfo group, a carboxyl group, a hydroxyl group and an amino group.

$D^1$ is preferably an alkyl group (those having preferably 1 to 12 carbon atoms such as methyl, ethyl, isopropyl, n-propyl and t-butyl groups), or an aryl group (those having preferably 6 to 10 carbon atoms such as phenyl, m-nitrophenyl, p-nitrophenyl, p-tolyl, naphthyl, m-chlorophenyl and p-chlorophenyl groups). $D^1$ is more preferably an aryl group (those having preferably 6 to 10 carbon atoms such as phenyl, m-nitrophenyl, p-nitrophenyl, p-tolyl, naphthyl, m-chlorophenyl and p-chlorophenyl groups).

$D^2$ to $D^5$ are preferably a hydrogen atom, or an alkyl group (those having preferably 1 to 12 carbon atoms such as methyl, ethyl, isopropyl, n-propyl and t-butyl groups), more preferably a hydrogen atom, or an alkyl group having 1 to 3 carbon atoms. Further, each of these groups may have a substituent. $D^{11}$ is preferably an unsubstituted alkyl group having 3 to 6 carbon atoms, or an alkyl group substituted with an alkyl group, an alkoxy group, a nitro group or a cyano group, more preferably an unsubstituted alkyl group having 3 to 6 carbon atoms, or an alkyl group substituted with a cyano group.

It is also preferred that $D^7$ has a structure represented by following formula (M-II) or (M-III):

Formula (M-II)

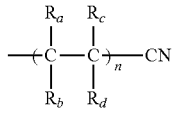

Formula (M-III)

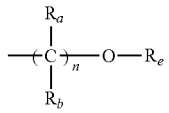

Wherein $R_a$, $R_b$, $R_c$ and $R_d$ each independently represents a hydrogen atom, an alkyl group, an aryl group, a heterocyclic group, a halogen atom, an alkoxy group, an aryloxy group, an amino group, an acyl group, an acyloxy group, an acylamino group, an alkylthio group, an arylthio group, a sulfonylamino group, a sulfonyl group, a sulfinyl group, a carbamoyl group, a sulfamoyl group, an alkoxycarbonyl group, or an aryloxycarbonyl group. Preferred are a hydrogen atom and an alkyl group (those having preferably 1 to 12 carbon atoms such as methyl, ethyl, isopropyl, n-propyl and t-butyl groups). More preferred are a hydrogen atom, a methyl group and an ethyl group. $R_e$ represents a hydrogen atom, an alkyl group, an aryl group, a heterocyclic group, a halogen atom, an alkoxy group, an aryloxy group, an amino group, an acyl group, an acyloxy group, an acylamino group, an alkylthio group, an arylthio group, a sulfonylamino group, a sulfonyl group, a sulfinyl group, a carbamoyl group, a sulfamoyl group, an alkoxycarbonyl group, or an aryloxycarbonyl group. Preferred are aryl groups (those having preferably 6 to 10 carbon atoms such as phenyl, m-nitrophenyl, p-nitrophenyl, p-tolyl, p-methoxyphenyl, naphthyl, m-chlorophenyl and p-chlorophenyl groups). n represents 1 to 5, preferably 1 to 3. When n is 2 or more, a plurality of $R_a$, $R_b$, $R_c$ and $R_d$ may be the same or different.

Of the dyes represented by formula (M), preferred are dyes represented by formula (MB).

Formula (MB)

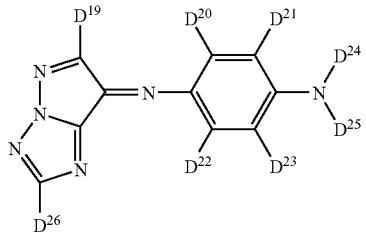

In formula (MB), $D^{19}$, $D^{20}$, $D^{21}$ $D^{22}$ and $D^{23}$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group. $D^{24}$ and $D^{25}$ each independently represent a hydrogen atom, an alkyl group, or an aryl group. $D^{24}$ and $D^{25}$ may be bonded together to form a ring. $D^{21}$ and $D^{24}$ and/or $D^{23}$ and $D^{25}$ may be bonded together to form a ring. $D^{26}$ represents a hydrogen atom, an alkyl group, an aryl group, an alkoxy group, an aryloxy group, or an amino group. And each of the above-mentioned groups may further be substituted.

Preferable examples of the dye represented by formula (M) are shown below, but the dyes that can be used in the present invention are not limited to the following specific examples.

M-1

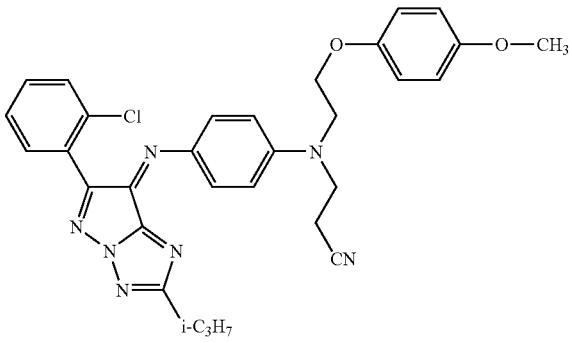

M-2

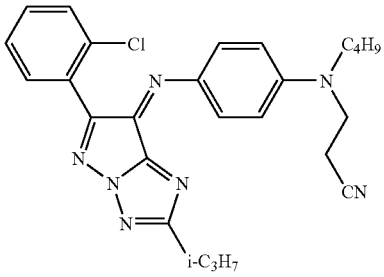

-continued

M-3

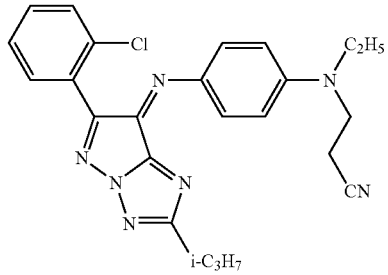

M-4

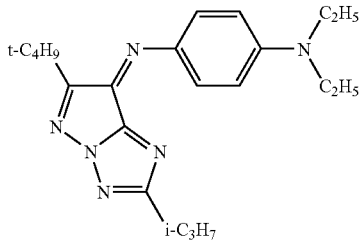

M-5

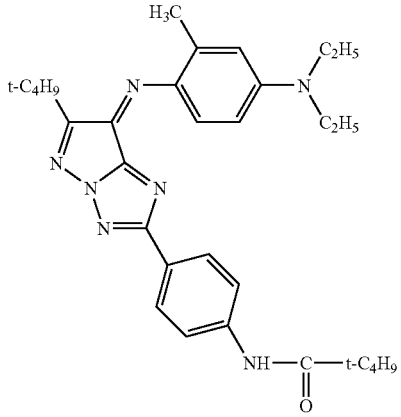

M-6

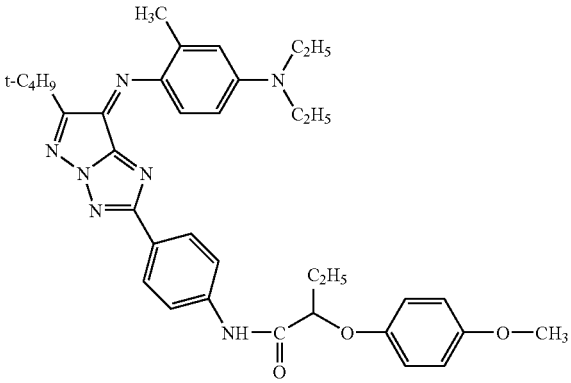

-continued

M-7

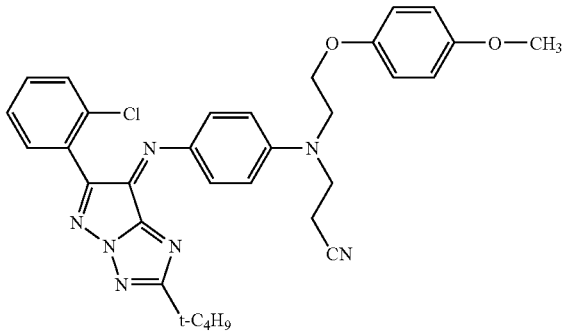

M-8

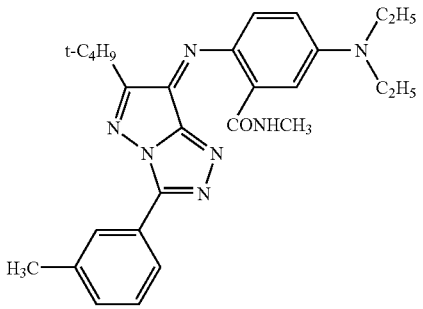

These compounds can be easily synthesized by the method described in JP-A-5-286268 or by a method similar to the method.

It is preferred to incorporate at least one compound represented by formula (M) as a magenta dye in a magenta heat transfer layer (magenta dye layer) of the ink sheet that is used in the present invention. It is possible to use the magenta dye together with an additional magenta dye. The additional magenta dye is not particularly limited, so far as the dye is able to diffuse by heat and/or able to be incorporated in a sublimation type heat-sensitive transfer sheet, and able to transfer by heat from the sublimation type heat-sensitive transfer sheet to a heat-sensitive transfer image-receiving sheet. Accordingly, as the additional magenta dye that is used for the heat-sensitive transfer sheet, ordinarily used dyes or known dyes can be effectively used. Of these additional magenta dyes, it is preferable to use dyes represented by formula (M2) set forth below. However, the magenta dyes that can be used in the present invention are not limited to these compounds.

The dye represented by formula (M2) is explained in detail below.

Formula (M2)

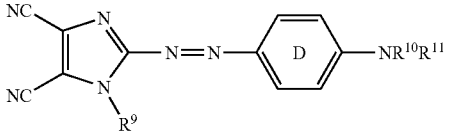

In formula (M2), the ring D represents a substituted or unsubstituted benzene ring; and $R^9$ represents a hydrogen atom, a substituted or unsubstituted alkyl group, a substituted or unsubstituted alkenyl group, or a substituted or unsubstituted aryl group. $R^{10}$ and $R^{11}$ each independently represent a substituted or unsubstituted alkyl group, a substituted or unsubstituted alkenyl group or a substituted or unsubstituted aryl group.

Each of the groups represented by $R^9$, $R^{10}$ and $R^{11}$ may further have a substituent. Examples of a substituent by which the ring D, $R^9$, $R^{10}$ and $R^{11}$ each may be substituted include the same substituents as each of the ring A, $R^1$ and $R^2$ in formula (Y1) may have.

Examples of a preferred combination of the substituent in a dye represented by formula (M2) include combinations wherein the ring D is a benzene ring substituted by an acylamino group having 2 to 8 carbon atoms; $R^9$ is a substituted or unsubstituted alkyl group having 1 to 8 carbon atoms or an acyl group; $R^{10}$ is a substituted or unsubstituted alkyl group having 1 to 8 carbon atoms or an allyl group; and $R^{11}$ is a substituted or unsubstituted alkyl group having 1 to 8 carbon atoms or an allyl group.

In more preferred combinations of the substituents, the ring D is a benzene ring substituted by an acylamino group having 2 to 6 carbon atoms; $R^9$ is a substituted or unsubstituted alkyl group having 1 to 6 carbon atoms or an acyl group; $R^{10}$ is a substituted or unsubstituted alkyl group having 1 to 6 carbon atoms or an allyl group, and $R^{11}$ is a substituted or unsubstituted alkyl group having 1 to 6 carbon atoms or an allyl group.

Preferable examples of the dye represented by formula (M2) are shown below, but the dyes that can be used in the present invention are not limited to the following specific examples.

M2-1

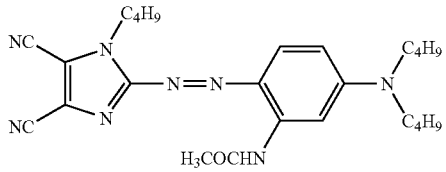

M2-2

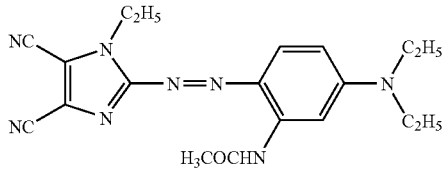

M2-3

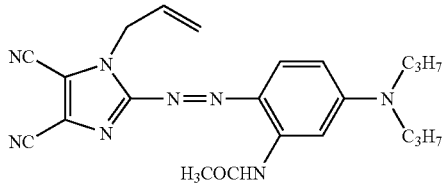

M2-4

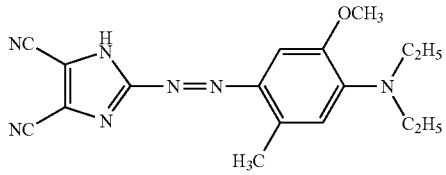

-continued

M2-5

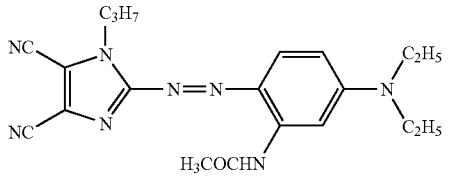

M2-6

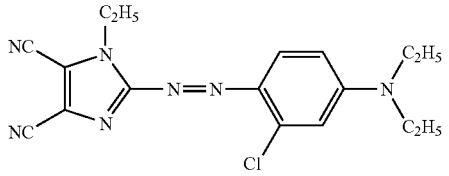

M2-7

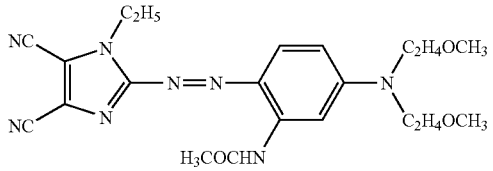

The dyes represented by formula (M2) can be synthesized by a known method.

Next, a cyan dye that can be preferably used in the present invention is explained below.

In the heat transfer layer of the ink sheet that is used in the present invention, use can be made of known dyes that have been used as a cyan dye from the past. Examples of the cyan dye include dyes represented by formula (C1) or (C2) set forth below. However, the cyan dyes that can be used in the present invention are not limited to these dyes.

First, the dye represented by formula (C1) is explained in detail.

Formula (C1)

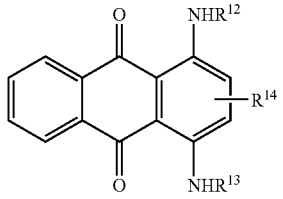

In formula (C1), $R^{12}$ and $R^{13}$ each independently represent a substituted or unsubstituted alkyl group, or a substituted or unsubstituted aryl group. $R^{14}$ represents a hydrogen atom or a substituent.

Each group of $R^{12}$ and $R^{13}$ may further have a substituent. Examples of a substituent by which each group of $R^{12}$ and $R^{13}$ may further be substituted include the same substituents as the ring A and each group of $R^1$ and $R^2$ in formula (Y1) may have. Examples of the substituent of $R^{14}$ include the same substituents as the ring A and each group of $R^1$ and $R^2$ in formula (Y1) may have.

Preferable examples of a substituent of $R^{14}$ include a halogen atom, an alkyl group, an alkenyl group, an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkyl- or arylsulfonylamino group, an alkylthio group, a sulfamoyl group, an alkyl- or arylsulfinyl group, an alkyl- or arylsulfonyl group, an acyl group, an aryloxycarbonyl group, an alkoxycarbonyl group and a carbamoyl group (each of these groups may further have a substituent.). More preferred examples of the substituent are a hydrogen atom, a halogen atom, an alkyl group, an alkenyl group, an aryl group, a heterocyclic group, an alkoxy group, an aryloxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, an alkylthio group, an acyl group, an aryloxycarbonyl group, an alkoxycarbonyl group and a carbamoyl group. And the further preferred are a halogen atom, a substituted or unsubstituted alkyl group having 1 to 4 carbon atoms, a substituted or unsubstituted alkenyl group having 2 to 8 carbon atoms, a substituted or unsubstituted aryl group having 6 to 10 carbon atoms, a substituted or unsubstituted heterocyclic group, an alkoxycarbonyl group, and an aryloxycarbonyl group. Of these substituents, a substituted or unsubstituted alkyl group having 1 to 4 carbon atoms and an alkoxycarbonyl group whose alkoxy moiety contains 1 to 4 carbon atoms are preferred over the others.

Examples of a preferred combination of the substituents in the dye represented by formula (C1) include combinations wherein $R^{12}$ is a substituted or unsubstituted alkyl group having 1 to 8 carbon atoms, or a substituted or unsubstituted aryl group having 6 to 10 carbon atoms; and $R^{13}$ is a substituted or unsubstituted alkyl group having 1 to 8 carbon atoms, or a substituted or unsubstituted aryl group having 6 to 10 carbon atoms.

In more preferred combinations, $R^{12}$ is a substituted or unsubstituted alkyl group having 1 to 6 carbon atoms, or a substituted or unsubstituted phenyl group, and $R^{13}$ is a substituted or unsubstituted alkyl group having 1 to 6 carbon atoms or a substituted or unsubstituted phenyl group.

Preferable examples of the dye represented by formula (C1) are shown below, but the dye that can be used in the present invention are not limited to the following specific examples.

C1-1

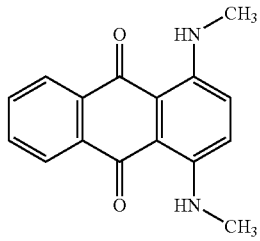

C1-2

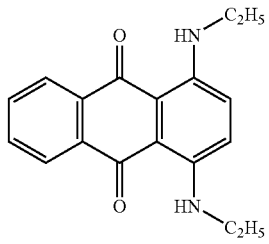

-continued

C1-3

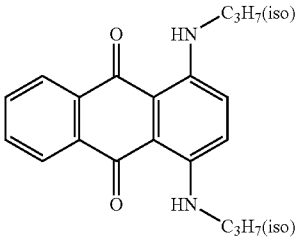

C1-4

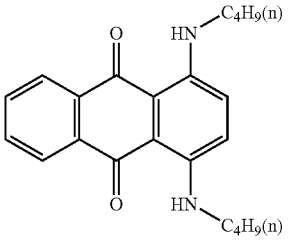

C1-5

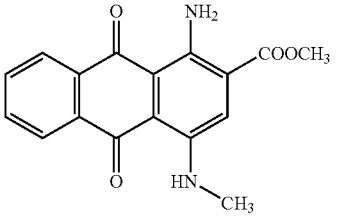

C1-6

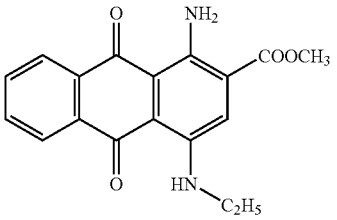

C1-7

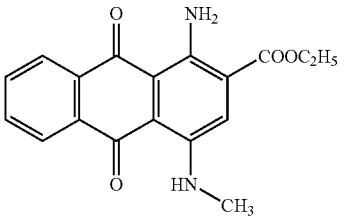

C1-8

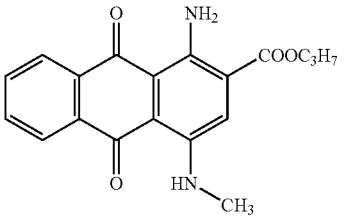

C1-9

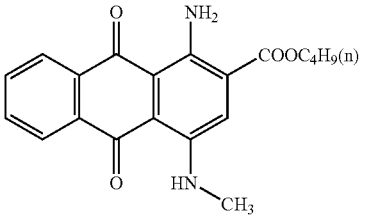

-continued

C1-10

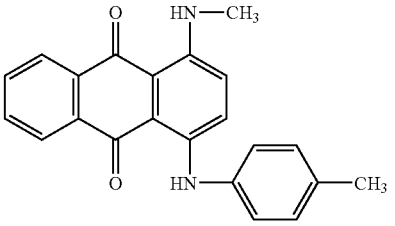

C1-11

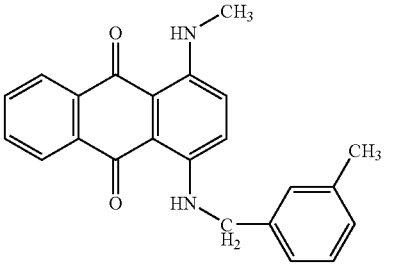

C1-12

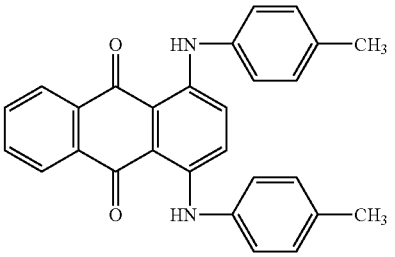

Among the dyes represented by the above-described formula (C1), those not available on the market can be synthesized according to the methods described in publications or specifications of U.S. Pat. Nos. 4,757,046 and 3,770,370, German Patent No. 2316755, JP-A-2004-51873, JP-A-7-137455, and JP-A-61-31292, and J. Chem. Soc. Perkin. Transfer I, 2047 (1977), *Merocyanine Dye-Doner Element Used in thermal Dye Transfer*, authored by Champan.

Next, the dye represented by formula (C2) is explained in detail.

Formula (C2)

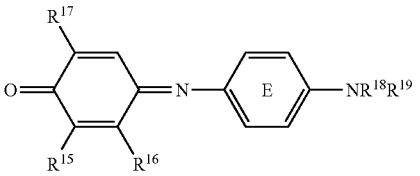

In formula (C2), the ring E represents a substituted or unsubstituted benzene ring; $R^{15}$ represents a hydrogen atom or a halogen atom; $R^{16}$ represents a substituted or unsubstituted alkyl group; $R^{17}$ represents a substituted or unsubstituted acylamino group or a substituted or unsubstituted alkoxycarbonylamino group; and $R^{18}$ and $R^{19}$ each independently represent a substituted or unsubstituted alkyl group, a substituted or unsubstituted alkenyl group, or a substituted or unsubstituted aryl group.

The ring E and each of the groups represented by $R^{16}$, $R^{17}$, $R^{18}$ and $R^{19}$ may further have substituents. Examples of substituents by which the ring E and each of the groups represented by $R^{16}$, $R^{17}$, $R^{18}$ and $R^{19}$ may be substituted are the same substituents as each of the ring A and the substituents $R^1$ and $R^2$ in formula (Y1) may have.

Examples of a preferred combination of the substituents in the dye represented by formula (C2) include combinations wherein the ring E is a benzene ring substituted by an alkyl group having 1 to 4 carbon atoms, a benzene ring substituted by a chlorine atom, or an unsubstituted benzene ring; $R^{15}$ is a hydrogen atom, a chlorine atom or a bromine atom; $R^{16}$ is a substituted or unsubstituted alkyl group having 1 to 8 carbon atoms; $R^{17}$ is a substituted or unsubstituted acylamino group having 2 to 10 carbon atoms, or a substituted or unsubstituted alkoxycarbonylamino group having 2 to 10 carbon atoms; $R^{18}$ is a substituted or unsubstituted alkyl group having 1 to 8 carbon atoms; and $R^{19}$ is a substituted or unsubstituted alkyl group having 1 to 8 carbon atoms.

In more preferred combinations, the ring E is a benzene ring substituted by an alkyl group having 1 to 2 carbon atoms, or an unsubstituted benzene ring; $R^{15}$ is a hydrogen atom or a chlorine atom; $R^{16}$ is a substituted or unsubstituted alkyl group having 1 to 6 carbon atoms; $R^{17}$ is a substituted or unsubstituted acylamino group having 2 to 8 carbon atoms, or a substituted or unsubstituted alkoxycarbonylamino group having 2 to 8 carbon atoms; $R^{18}$ is a substituted or unsubstituted alkyl group having 1 to 6 carbon atoms; and $R^{19}$ is a substituted or unsubstituted alkyl group having 1 to 6 carbon atoms.

Preferable examples of the dye represented by formula (C2) are shown below, but the dyes that can be used in the present invention are not limited to the following specific examples.

C2-1

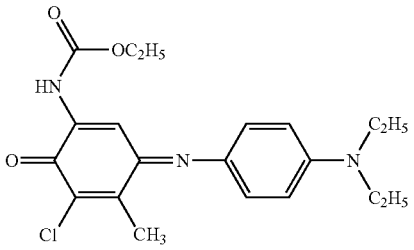

C2-2

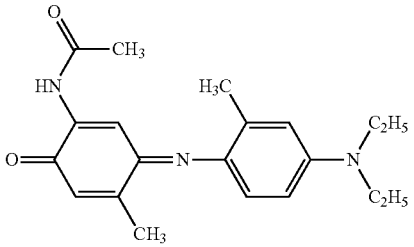

C2-3

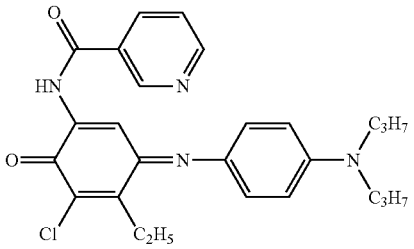

-continued

C2-4

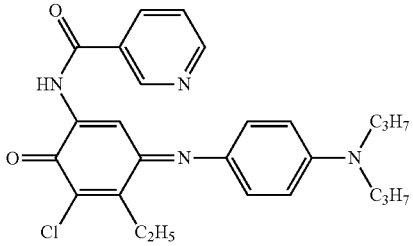

C2-5

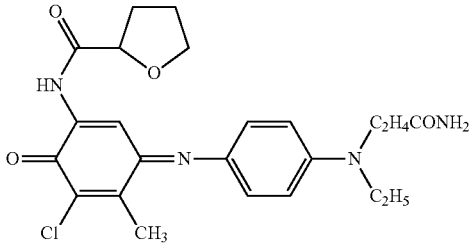

C2-6

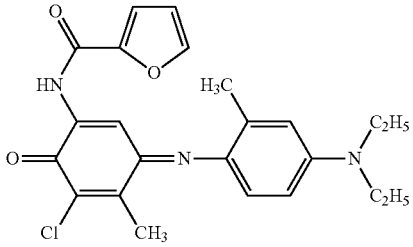

C2-7

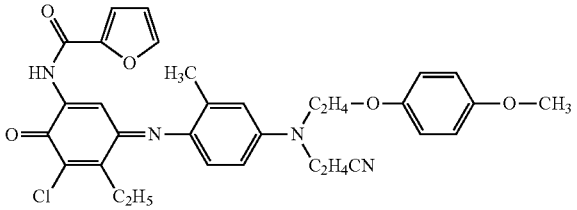

The dye represented by formula (C2) can be synthesized according to a usual manner.

As the binder resins that are contained in a dye ink in order to carry the above-described dyes, various materials are known and are able to be used in the present invention. Examples of the resins include modified cellulose resins such as ethyl cellulose, hydroxyethyl cellulose, ethyl hydroxycellulose, hydroxypropyl cellulose, ethylhydroxyethyl cellulose, methyl cellulose, cellulose acetate, cellulose acetate butyrate, cellulose acetate propionate, and cellulose nitrate; vinyl resins such as polyvinyl alcohol, polyvinyl acetate, polyvinyl butyrate, polyvinyl acetal, polyvinyl pyrroridone, polystyrene, and polyvinyl chloride; acrylic resins such as polyacrylonitrile, polyacrylic acid ester, and polyacrylamide; polyurethane resins; polyamide resins; polyester resins; polycarbonate resins; phenoxy resins; phenol resins; epoxy resins; and various kinds of elastomers. Each of these resins set forth above are preferably used. These resins may be used alone, or mixed together. In the case of polymers, various kinds of resin-constituting monomers may be copolymerized before use. It is also a preferable embodiment to bridge the polymers with various kinds of cross-linking agents.

Especially, modified cellulose resins and vinyl resins are preferably used. More preferably used are propionic acid-modified cellulose resins, polyvinyl butyral and polyvinyl acetal.

The dye ink can be prepared by dissolving or dispersing the above-described sublimation type dye and binder resin in a solvent. As the solvent that is used at the time of preparation, various kinds of known solvents can be used. Examples of the solvent include alcohol solvents such as methanol, ethanol, isopropyl alcohol, butanol, and isobutanol; ketone solvents such as methylethyl ketone, methylisobutyl ketone, and cyclohexanone; aromatic solvents such as toluene and xylene; and water. The solvents may be used singly, or as a mixture thereof.

In addition to the dye and the binder, various kinds of additives can be added to the dye layer in order to improve various performances such as storage stability, traveling properties in a printer, and releasing properties after printing. As typical additives, organic or inorganic fine particles and waxes are preferably used.

As the organic particles, it is preferred to use fine particles of the resin exemplified by polyolefin resins such as polyethylene and polypropylene, fluorine resins, polyamide resins such as nylon resins, urethane resins, styrene-acryl series crosslinked resins, phenol resins, urea resins, melamine resins, polyimide resins, and benzoguanamine resins. Polyethylene fine particles are more preferably used. As the inorganic particles, it is preferred to use fine particles of, for example, calcium carbonate, silica, clay, talc, titanium oxide, magnesium hydroxide, or zinc oxide.

The organic or inorganic fine particles are preferably contained in a range of from 0.5 to 5% by mass, based on the binder resin of the dye layer.

It is also a preferable embodiment that a wax is contained to the dye layer in addition to the above-described sublimation type dye, binder, and organic or inorganic fine particles. As the wax that can be used, preferred are waxes derived from petroleum such as microcryastalline wax and paraffin wax; waxes derived from mineral such as montan wax; waxes derived from plants such as carnauba wax, Japan wax and candelilla wax; waxes derived from animals such as bees wax, spermaceti, insect wax and shellac wax; synthetic waxes such as Fischer-Tropsch wax, various kinds of low molecular polyethylene, aliphatic acid esters, aliphatic acid amides and silicone wax and partially modified waxes.

Further, another preferable embodiment is to contain resins such as silicone resin, fluorine resin, acrylic resin, cellulose resin, vinyl chloride-vinyl acetate copolymer, and pyroxylin in the ink for dye layer. These waxes and resins may be contained in the dye layer in the range of from 0.1% by mass to 10% by mass, preferably from 1% by mass to 3% by mass, based on the total solid content of the dye layer.

Next, explained is a composition of the heat-sensitive transfer sheet that is used in the present invention.

The heat-sensitive transfer sheet that can be used in the present invention has at least one dye layer containing at least one dye, which is disposed on one surface of the support, and the dye layer is formed by applying a coating liquid for dye layer. Further, it is preferred that the heat-sensitive transfer sheet that can be used in the present invention has at least one yellow dye layer, at least one magenta dye layer, and at least one cyan dye layer.

(Support)

As the support, any one of previously known materials can be used, so far as such the material has both a heat resistance and a mechanical strength necessary to the requirements for the support. Specific examples of preferable supports include thin papers such as a glassine paper, a condenser paper, and a paraffin paper; high-temperature polyesters such as polyethyleneterephthalate, polyethylenenaphthalate, polybuyleneterephthalate, polyphenylene sulfide, polyetherketone, and polyethersulfone; stretched or unstreched films of plastics such as polypropylene, polycarbonate, cellulose acetate, polyethylene derivatives, poly(vinyl chloride), poly(vinylidene chloride), polystyrene, polyamide, polyimide, polymethylpentene, and ionomers; and laminates of these materials. Of these materials, polyester films are especially preferred. A thickness of the support can be properly determined in accordance with the material of the support so that the mechanical strength and the heat resistance become optimum. Specifically, it is preferred to use a support having a thickness of about 1 μm to about 100 μm, more preferably from about 2 μm to about 50 μm, and further preferably from about 3 μm to about 10 μm.

It is essential in the sublimation type heat-sensitive transfer recording system that only dye(s) having each hue that is contained in a heat-sensitive transfer sheet must be transferred at the time of printing. Transfer of a resin carrying the dye is not preferred. Therefore, a strong adhesion between a dye layer and a support of the heat-sensitive transfer sheet is required. If the adhesion is weak, the dye layer in itself adheres to a heat-sensitive transfer image-receiving sheet, thereby resulting in deterioration of image quality of printing.

In the case of the support such as a polyester film exemplified above as a preferable support, wettability of the ink with each hue as described later is not so sufficient that adhesive strength occasionally lacks.

In order to deal with such the problem, it is preferred to employ a method of physically treating a surface of the support, and/or a method of forming an easy adhesion layer.

It is preferred to form an easy adhesion layer composed of a resin on a support and to dispose a dye layer on the easy adhesion layer. As a resin for forming the easy adhesion layer, there can be used, for example, urethane resins, polyester resins, polypropylene resins, polyol resins, acrylic resins, and reaction products of these resins and isocyanate compounds. Examples of the isocyanate compound include diisocyanate compounds and triisocyanate compounds, each of which is conventionally used. A coating amount of the resin preferably ranges from 0.05 $g/m^2$ to 0.1 $g/m^2$.

In the production of the heat-sensitive transfer sheet, a support on which an easy adhesion layer is disposed in advance can be used, and a dye layer can be formed on the said support.

(Dye Layer)

The dye layer that is used in the present invention is formed by applying a coating liquid (an ink) for the dye layer on a support using a gravure printing method or other forming means, followed by drying. The ink for dye layer is obtained by dissolving or dispersing a sublimation type dye, a binder resin and optionally used additives such as organic or inorganic finely divided powder and waxes in a proper solvent.

A thickness of the dye layer is preferably in the range of from about 0.2 $g/m^2$ to about 5 $g/m^2$, more preferably from about 0.4 $g/m^2$ to about 2 $g/m^2$ at the dry state.

A content of the sublimation type dye in the dye layer is preferably in the range of from 5% by mass to 90% by mass, more preferably from about 10% by mass to about 70% by mass.

It is preferred to incorporate at least one cyan dye in the magenta dye layer of the dye layers that is used in the present invention. In this embodiment, it is preferred that a content of the cyan dye in the magenta dye layer is in the range of from 2% by mass to 10% by mass.

It is also a preferable embodiment that the magenta dye layer contains at least one magenta dye represented by the aforementioned formula (M) and at least one cyan dye represented by the aforementioned formula (C1). Further, it is also another preferable embodiment that the magenta dye layer contains at least one magenta dye represented by the aforementioned formula (M) and at least one cyan dye represented by the aforementioned formula (C2).

Next, the heat-sensitive transfer sheet that is used in the present invention is explained in detail with reference to drawings. However, the present invention is not limited to these embodiments.

In the heat-sensitive transfer sheet that is used in the present invention, at least one dye layer with at least one dye is disposed. It is an ordinary way that the yellow dye, magenta dye and cyan dye are generally transferred in this order in the heat-sensitive transfer sheet. Therefore, it is preferred to dispose dye layers with each of hues of the yellow heat transfer layer Y, the magenta heat transfer layer M and the cyan heat transfer layer C in area order on the same support as shown in FIG. 1(*a*). In addition, a black layer BK may be further disposed as shown in FIG. 1(*b*). Further, a transferable protective layer laminate 4 may be disposed between each of dye layers 3 composed of Y, M, C and BK as shown in FIG. 1(*c*). However, arrangement of the dye layers with each hue according to the present invention is not limited to these arrangements, but any arrangement can be employed in accordance with necessity.

Further, a releasing property between a heat-sensitive transfer sheet and a heat-sensitive transfer image-receiving sheet and the like are changed depending on the printing order. Therefore, it is also a preferable embodiment to change a content of additives for use in each of the dye layers in response to the change of releasing properties. For example, as a dye layer is used later for printing, it is possible to increase a content of the releasing agent in the dye layer.

FIG. 2 is a plane view showing one embodiment of the heat-sensitive transfer sheet used in the present invention. It is also possible to form each of dye layers with each hue on a separate support, in place of disposing the dye layers with each hue on the same support as shown in FIG. 2.

A total thickness of the dye layers having a multilayer structure is preferably in the range of from about 0.2 g/m$^2$ to about 5 g/m$^2$, more preferably from about 0.4 g/m$^2$ to about 2 g/m$^2$. A thickness of one constituting layer of the dye layer is preferably in the range of from about 0.2 g/m$^2$ to about 2 g/m$^2$. A total content of the sublimation type dye in the total dye layers is preferably in the range of from 5% by mass to 90% by mass, more preferably from about 10% by mass to about 70% by mass.

(Transferable Protective Layer Laminate)

It is a preferable embodiment in the present invention to dispose a transferable protective layer laminate in the heat-sensitive transfer sheet. The transferable protective layer laminate is used to protect a heat-sensitive transferred image by forming a protective layer composed of a transparent resin on the heat-sensitive transferred image by heat-sensitive transfer, thereby to improve durability such as scratch resistance, light-fastness, and resistance to weather. Under the conditions that a dye transferred to the image-receiving sheet is left to be exposed at the surface of the image-receiving sheet, image durability, such as light-fastness, scratch resistance, and chemical resistance, are unsatisfactory. Therefore, it is preferred to dispose the transparent protective layer. FIG. 3 is a cross-sectional view showing an example of the heat-sensitive transfer sheet according to the present invention. As exemplified in FIG. 3, it is possible to form a back layer 5 on one surface of the support 2 and to form, on the other surface of the support, a transferable protective layer laminate that is composed of a release layer 4*a*, a protective layer 4*b* and an adhesion layer 4*c* in this order from the support as a preferable embodiment of the heat-sensitive transfer sheet of the present invention. The protective layer 4*b* may be formed of a plurality of layers. In the case where the protective layer 4*b* has both functions of the protective layer and the other layer, the releasing layer 4*a* and/or the adhesion layer 4*c* may be omitted. As the support 2, it is possible to use a support on which an easy adhesion layer is disposed. 3 denotes an ink layer. 5 denotes a back layer.

As a resin forming the protective layer, preferred are resins that are excellent in scratch resistance, chemical resistance, transparency and hardness. Examples of the resin include polyester resins polystyrene resins, acrylic resins, polyurethane resins, acrylic urethane resins, silicone-modified resins of the above-described resins, mixtures of these resins, ionizing radiation-curable resins, and ultraviolet-shielding resins. In addition, there can be used various kinds of resins that are conventionally known as a resin for forming protective layer. Further, in order to give ultraviolet absorbing capacity, or to improve coat separation properties at the time of transfer, gloss, brightness, or the like, it is also preferred to add ultraviolet absorbing agents, antioxidants, fluorescent brightening agents, organic fillers and/or inorganic fillers in accordance with necessity.

As the acrylic resin that can be used in the present invention, it is preferable that polymers derived from at least one monomer selected from conventionally known acrylate monomers and methacrylate monomers. Other monomers than these acrylate-series monomers, such as styrene and acrylonitrile may be co-polymerized with said acryl-series monomers. A preferred monomer is methyl methacrylate. It is preferred that methyl methacrylate is contained in terms of preparation mass ratio of 50 mass % or more in the polymer.

Examples of an acid component of the polyester resin used in the present invention, include aromatic dicarboxylic acids such as phthalic acid, isophthalic acid, orthophthalic acid, 2,6-naphthalene dicarboxylic acid, teterahydrophthalic acid, hexahydrophthalic acid, hexahydroisophthalic acid, and hexahydroterephthalic acid; aliphatic dicarboxylic acids such as succinic acid, adipic acid, azelaic acid, sebacic acid, dodecanedionic acid, and dimmer acid; and alicyclic dicarboxylic acids such as cyclohexane dicarboxylic acid, tricyclodecane dicarboxylic acid, and decalin dicarboxylic acid. Methyl-esterified derivatives of these compounds may be also used. Further, acid anhydrides of these compounds may be also used.

Further, if necessary, the above-mentioned compounds may be also used together with other compounds such as p-(hydroxyethoxy)benzoic acid, hydroxypivalic acid, γ-butyryllactone, ϵ-caprolactone, fumaric acid, maleic acid, maleic acid anhydrate, itaconic acid, and citraconic acid. Further, if necessary, the above-mentioned compounds may be also used together with tri- or more multi-functional polycarboxylic acids such as tri and tetra carboxylic acids (e.g., trimellitic acid, pyromellitic acid), in so far as the proportion of the tri- or more multi-functional polycarboxylic acids is 10 mol % or less of the entire carboxylic acid components. Particularly preferred is the composition that contains at least one acid component which is an aromatic carboxylic acid a part of which is substituted with a sulfonic acid or a salt thereof, in one molecular chain. It is preferable to conduct polymerization with setting the upper limit of a substitution amount of the sulfonic acid (or salt thereof) within a range that ensures solubility to organic solvents, since this would make it possible to use the polyester resin with mixing with other organic-solvent-soluble additives or resins. As a preferable aromatic dicarboxylic acid substituted with the sulfonic acid (or salt thereof), there are exemplified sulfoterephthalic acid, 5-sulfoisophthalic acid, 4-sulfophthalic acid, 4-sulfonaphthalene-2,7-dicarboxylic acid, 5-(4-sulfophenoxy)isophthalic acid, ammonium salts of these acids, and metal salts of these acids wherein examples of the metal include lithium, potassium, magnesium, calcium, copper, and iron. Of these acids, sodium salt of 5-sulfoisophthalic acid is especially preferred.

Examples of a polyol component that is another component of the polyester resin that can be used in the present invention, include ethylene glycol, 1,2-propylene glycol, 1,3-propane diol, 1,4-butane diol, neopentyl glycol, 1,5-pentane diol, 1,6-hexane diol, 3-methyl-1,5-pentane diol, 1,9-nonane diol, 2-ethyl-2-butylpropane diol, hydroxypivalic acid neopentylglycol ester, dimethylolheptane, and 2,2,4-trimethyl-1,3-pentane diol. If necessary, there can be also used diethylene glycol, triethylene glycol, dipropylene glycol, polyethylene glycol, polypropylene glycol, polytetramethylene glycol, ethylene oxide adducts of neopentyl glycol, and propylene oxide adducts of neopentyl glycol.

As aromatic-group-containing glycols, there are paraxylene glycol, metaxylene glycol, orthoxylene glycol, 1,4-phenylene glycol, ethylene oxide adduct of 1,4-phenylene glycol, bisphenol A, and glycols obtained by adding from 1 to several moles of ethylene oxide or propylene oxide to the two phenolic hydroxyl groups of bisphenols, such as ethylene oxide adducts or propylene oxide adducts of bisphenol A. Examples of alicyclic diol components include tricyclodecane diol, tricyclodecane dimethylol, tricyclodecane dimethanol (TCD-M), cyclohexane diol, 1,4-cyclohexane dimethanol, hydrogenated bisphenol A, ethylene oxide adducts or propylene oxide adducts of hydrogenated bisphenol A. As the above-described polyester resin, a preferable glass transition temperature ranges from 50° C. to 120° C., and a preferable molecular weight ranges from 2,000 to 40,000. A molecular weight ranging from 4,000 to 20,000 is more preferred, because so-called "foil-off" properties at the time of transfer of the protective layer are improved.

The use of the ionizing radiation-curable resins enables to obtain a protective layer that is excellent in both resistance to plasticizers and scratch resistance in particular. As an example, there are resins that are obtained by cross-linking and curing radical polymerizable polymers or oligomers upon irradiation of ionizing radiation. At this moment, polymerization and cross-link may be performed by adding a photopolymerization initiator in accordance with necessity, followed by irradiation of electron beam or ultraviolet ray. Further, known ionizing radiation-curable resins can be used.

It is also a preferable embodiment that a protective layer contains ultraviolet-absorbing agents and/or ultraviolet-shielding resins in order to give light-fastness to the printed matter.

As the ultraviolet absorbing agents, use can be made of conventionally known inorganic or organic ultraviolet absorbing agents. As the organic ultraviolet absorbing agents, use can be made of non-reactive ultraviolet absorbing agents such as salicylate-series, benzophenone-series, benzotriazole-series, triazine-series, substituted acrylonitrile-series, nickel chelate-series, and hindered amine-series ultraviolet absorbing agents; and copolymers or graft polymers of thermoplastic resins (e.g., acrylic resins) and activated products obtained by introducing to the above-described non-reactive ultraviolet absorbing agents; addition-polymerizable double bonds originated from a vinyl group, an acryroyl group, a methacryroyl group, or the like, or alternatively by introducing thereto other types of groups such as an alcoholic hydroxyl group, an amino group, a carboxyl group, an epoxy group, and an isocyanate group. Of these ultraviolet absorbing agents, preferred are organic ultraviolet absorbing agents as described below, especially benzophenone-series, benzotriazole-series, and triazine-series ultraviolet absorbing agents.

In addition, disclosed is a method of obtaining ultraviolet-shielding resin by the steps of dissolving ultraviolet absorbing agents in a monomer or oligomer of the resin that is used in the protective layer, and then polymerizing the monomer or oligomer (JP-A-2006-21333). In this case, it is preferred that the ultraviolet absorbing agents are not reactive.

Examples of the articles that have been sold as ultraviolet absorbing agents on the market include Tinuvin-P (a product of Ciba-Geigy), JF-77(a product of JOHOKU CHEMICAL), SEA SOUP 701 (a product of SHIROISHI CALCIUM), SUMI SOUP 200 (a product of Sumitomo Chemical), BIO SOUP 520 (a product of KYODO CHEMICAL), and ADK STAB LA-32 (a product of ADEKA).

With respect to these ultraviolet-absorbing agents, it is preferred to use a combination of ultraviolet-absorbing agents having a different system from each other so that an effective ultraviolet-absorbing wavelength region can be covered in accordance with characteristics of the dye that is used for image formation. With respect to the non-reactive ultraviolet-absorbing agents, a mixture of ultraviolet-absorbing agents having a different structure from each other is preferably used in order to prevent the ultraviolet-absorbing agent from precipitation.

Examples of the organic fillers and/or the inorganic fillers include polyethylene wax, bis-amide, nylon, acrylic resin, cross-linked polystyrene, silicone resin, silicone rubber, talc, calcium carbonate, titanium oxide, alumina, and silica fine particles such as micro silica and colloidal silica. In the heat-sensitive transfer sheet according to the present invention, not only these exemplified materials, but also known other materials can be used preferably.

With respect to the organic fillers and/or the inorganic fillers, it is preferred that not only a particle size of the fillers is 10 μm or less, preferably in the range of from 0.1 μm to 3 μm but also the fillers have good sliding properties and high transparency. An addition amount of the filler is preferably a degree to which transparency is kept at the time of transfer. Specifically, the addition amount is preferably in the range of from 0 to 100 mass parts, based on 100 mass parts of the resin.

Depending on the kind of resin for forming protective layer, the protective layer is formed by the same method as the method of forming the above-described dye layer. A thickness of the protective layer is preferably in the range of from about 0.5 μm to about 10 μm.

(Releasing Layer)

In the case where a protective layer is difficult to separate from a support at the time of transfer, it is also a preferable embodiment to form a release layer 4*a* between the support and the protective layer. The release layer can be formed by the steps of preparing a coating liquid composed of a material that is excellent in release properties, such as waxes, silicone wax, silicone resin, and fluorine resin; a relatively high melting point resin that does not melt by heat from a thermal head, such as cellulose-based resin, acrylic resin, polyurethane resin, polyvinyl acetal resin, acrylic vinyl ether-based resin, maleic acid anhydride resin, silicone resin, fluorine resin; or the above-described resins containing a heat release agent such as waxes, and then coating the coating liquid according to a previously known coating method such as gravure coat and gravure reverse coat, followed by drying. Of these resins, preferred are acryl resins obtained by polymerizing acrylic acid or methacrylic acid singly, or copolymerizing acrylic acid or methacrylic acid with other monomers. These acrylic resins are excellent in adhesion to the substrate sheet, and release properties from the protective layer. Further, these resins may be used alone or in a combination of these resins.

The releasing layer remains at the side of a support at the time of printing (transfer).

A thickness of the release layer is preferably in the range of from about 0.5 μm to about 5 μm. Various kinds of particles are incorporated in the release layer, or alternatively a surface of the release layer at the protective layer-coating side is subjected to a matt treatment, thereby to mat the surface of the release layer. Resultantly, the surface of the image-receiving sheet after printing can be mat-finished (flatten).

A separation layer may be formed between a transferable protective layer and a releasing layer. The separation layer is transferred together with the protective layer. After transfer, the separation layer becomes the outermost layer of the printed image-receiving sheet. Therefore, the separation layer is composed of a resin that is excellent in transparency, abrasion resistance and chemical resistance. As the resin, there are exemplified acrylic resin, epoxy resin, polyester resin, and styrene resin. Further, additives such as fillers and waxes may be added to the separation layer.

(Adhesion Layer)

It is preferred to dispose an adhesion layer on a protective layer as the outermost layer of the transferable protective layer laminate. Thereby, transfer properties of the protective layer are improved. In the adhesion layer, there can be used known pressure-sensitive adhesives, heat-sensitive adhesives, and thermoplastic resins. Specific examples of the adhesives include resins that are excellent in adhesiveness at the time of heating, such as polyester resin, vinyl chloride-vinyl acetate copolymer resin, acrylic resin, acrylic material-ultraviolet absorbing agent copolymer resin, ultraviolet absorbing resin, butyral resin, epoxy resin, polyamide resin, vinyl chloride resin, and polycarbonate resin. Of these resins, preferred are thermoplastic resins having a glass transition temperature of from 40° C. to 80° C.

If Tg is less than 40° C., adhesiveness between the coated image and a transparent protective layer tends to become insufficient. On the other hand, if Tg is more than 80° C., transfer properties of the transparent protective layer tends to become insufficient.

Further, especially preferred are polyvinylchloride resins, polyvinyl acetate resins, and vinyl chloride-vinyl acetate copolymer resins, each of which has a polymerization degree of from 50 to 300, more preferably from 50 to 250.

As the ultraviolet absorbing resin, there can be used resins such as products that are obtained by reaction and bonding of a thermoplastic resin or an ionizing radiation curable resin with a reactive ultraviolet absorbing agent.

More specifically, use can be made of resins that are obtained by reaction and bonding between a reactive ultraviolet absorber and a thermoplastic resin or an ionizing radiation curable resin. In the said reactive ultraviolet absorber, a reactive group such as an addition-polymerizable double bonding (e.g., vinyl, acryloyl, methacryloyl groups), an alcoholic hydroxyl group, an amino group, a carboxyl group, an epoxy group, and a isocyanate group has been introduced into a previously known non-reactive organic ultraviolet absorber such as salicylate series, phenyl acrylate series, benzophenone series, benzotriazole series, coumarine series, triazine series, nickel chelate series, substituted acrylonitrile series, and hindered amine series ultraviolet absorbers.

To the adhesion layer, the followings may be added: the above-described resins and additives including organic ultraviolet absorbing agents such as benzophenone-series compounds, benzotriazole-series compounds, oxalic anilide-series compounds, cyanoacrylate-series compounds, and salicylate-series compounds, and inorganic fine particles having ultraviolet absorbing capacity (for example, oxides of metal such as zinc, titanium, cerium, tin, and iron).

Further, it is optional to add other additives such as coloring pigments, white pigments, extender pigments, fillers, antistatic agents, antioxidants, and fluorescent whitening agents in accordance with necessity. The adhesion layer is formed by coating and then drying a coating liquid containing the above-described resin for construction of the adhesion layer, and the above-described additives that are optionally added to the adhesion layer, so that a thickness of the adhesion layer preferably becomes a range of from 0.5 μm to about 10 μm at the dry state. A dry thickness of the adhesion layer preferably ranges from 0.5 μm to 5 μm, more preferably from 0.5 μm to 3 μm.

(Back Layer)

The back surface of the heat-sensitive transfer sheet directly contacts with a heating device such as a thermal head, and the sheet travels while the back surface is heated. Therefore, it is preferred to dispose a back layer on the back surface of a support in order to smooth the traveling by preventing the back surface from being heat sealed with the heating device such as a thermal head.

In the back layer, there can be used alone or a mixture of natural or synthetic resins such as cellulosic-series resins (for example, ethyl cellulose, hydroxy cellulose, hydroxypropyl cellulose, methyl cellulose, cellulose acetate, cellulose acetate butyrate, and nitro cellulose), vinyl-series resins (for example, polyvinyl alcohol, polyvinyl acetate, polyvinyl acetal, and polyvinyl pyrrolidone), acrylic-series resins (for example, polymethyl methacrylate, polyethyl methacrylate, polyacryl amide, and acrylonitrile-styrene copolymer), polyamide resins, polyvinyl toluene resins, cumarone indene resins, polyester-series resins, polyurethane resins, silicone-modified or fluorine-modified polyurethane resins, and silicone resins.

In order to improve heat resistance of the back layer, it is a preferable embodiment that the back layer is modified with a crosslinking agent into a crosslinked resin layer.

Further to improve traveling, it is preferable to contain a solid or liquid releasing agent or lubricant in a back layer. As the solid or liquid releasing agent or lubricant, known compounds can be used. Examples of these compounds include various kinds of waxes such as zinc stearate, stearic acid amide, carnauba wax, montan wax, polyethylene wax, and paraffin wax, higher aliphatic acid alcohol, organopolysiloxane, anionic surfactants, cationic surfactants, amphoteric surfactants, nonionic surfactants, fluorine surfactants, organic carboxylic acid and their derivatives, fluorine resins, silicone resin, phosphoric acid ester compounds, and organic or inorganic fine particles.

Such the back layer can be formed using a known coating method. A thickness of the back layer is preferably in the range of from 0.1 μm to 10 μm, more preferably from 0.3 μm to 5 μm, and especially preferably from 0.5 μm to 3 μm.

Hereinafter, in the present invention, the heat-sensitive transfer sheet and the method of producing the same will be explained.

Taking as an example the case where each of yellow, magenta and cyan dye layers has been formed in area order on the same support, the heat-sensitive transfer sheet has a long and narrow support sheet, each of yellow, magenta and cyan dye regions (heat-sensitive transfer layers) disposed at different positions from each other in the longer direction of the support, and a detecting mark disposed at the ends of the dye regions on the support. The detecting mark is disposed perpendicular to the longer direction.

For formation of these layers, there can be used known coating methods. Examples of the coating methods include roll coat, bar coat, gravure coat, and gravure reverse coat.

Taking as an example the printing method using a printing cylinder, first a yellow dye region is printed using a yellow printing cylinder, second a magenta dye region is printed using a magenta printing cylinder, and third a cyan dye region is printed using a cyan printing cylinder. At last, detecting marks are simultaneously printed using a mark printing cylinder.

It is possible to print using printing plate portions of plural dye layers disposed on the same printing cylinder (multiple plating). However, in this method, there is sometimes the case where the manufactured transfer layers are delicately different in thickness or the like from each other owing to a manufacturing error or the like of each printing plate portion. If a printing (dye transfer to the image-receiving sheet) is performed using the thus-prepared heat-sensitive transfer sheet, a difference in color hue is easy to occur. For prevention from this trouble, it is possible to print different detecting marks for each at least one region of each of the dye layer regions, or for every each pair of the dye layer regions.

In the above, there was explained the case where the heat-sensitive transfer sheet has each of the yellow, magenta and cyan dye layer regions. However, the present invention is not limited to such the composition, but a black layer or a transferable protective layer laminate may be disposed in addition to the above-described three color dye layers.

Hereinafter, the heat-sensitive transfer image-receiving sheet preferably used in the present invention will be explained.

(Receptor layer)

The receptor layer performs functions of receiving dyes transferred from an ink sheet and retaining an image formed. The image-receiving sheet of the present invention has at least one receptor layer preferably containing at least one thermoplastic receiving polymer that can receive a dye.

The receptor polymer is preferably used in the form of latex polymer in which the polymer is dispersed in an aqueous dispersion medium. Further, the receptor layer preferably contains a water soluble polymer in addition to the latex polymer. Incorporation of both the latex polymer and the water soluble polymer enables to arrange the water soluble polymer that is hardly colored with a dye among the latex polymer, so that diffusion of the dye with which the latex polymer has been colored can be prevented. Consequently, a fluctuation in sharpness of the receptor layer with the lapse of time can be reduced, and it is possible to form a recorded image with a little change of a transfer image with the lapse of time.

In the receptor layer, the latex polymer that is used as a receptor polymer can be used together with another functional latex polymer for purposes, such as regulation of elastic coefficient of the film.

Beside, in the receptor layer, there can be contained ultraviolet absorbers, releasing agents, lubricant, antioxidants, antiseptics, surfactants, and other additives.

The latex polymer (polymer latex) that can be used in the present invention is explained.

In the heat-sensitive transfer image-receiving sheet of the present invention, the latex polymer that can be used in the receptor layer is a dispersion in which a water-insoluble hydrophobic polymer is dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. In the present invention, the average diameter of the dispersed particles is preferably in the range of approximately 1 to 50,000 nm, more preferably 5 to 1,000 nm.

In the present invention, the particle diameter distribution of the dispersed particles is not particularly limited, and thus, the particles may have a wide particle diameter distribution or a monodispersion-like particle diameter distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer that can be used in the present invention is preferably −30° C. to 130° C., more preferably 0° C. to 120° C. Especially, the glass transition temperature is preferably 40° C. or more (preferably from 40° C. to 120° C.), and more preferably 70° C. or more (from 70° C. to 100° C.).

In the present invention, latex polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight. A polymer having an excessively small molecular weight imparts insufficient dynamic strength to a layer containing a latex of the polymer, and a polymer having an excessively large molecular weight brings about poor filming ability, and therefore both cases are undesirable. Crosslinkable polymer latexes are also preferably used.

In synthesis of the latex polymer used in the present invention, there is no particular limitation to monomers to be used, and the following monomer groups (a) to (j) may be preferably used as those polymerizable in a usual radical polymerization or ion polymerization method. These monomers may be selected singly or combined freely to synthesize the latex polymer.

Monomer groups (a) to (j)

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multiftinctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

The latex polymer that can be used in the present invention is also commercially available, and polymers described below may be utilized in combination.

Examples of the acrylic-series polymers include Cevian A-4635, 4718, and 4601 (trade names, manufactured by Daicel Chemical Industries); Nipol Lx811, 814, 821, 820, 855 (P-17: Tg 36° C.), and 857×2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K. K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, and NS-282LX (trade names, manufactured by Takamatsu Yushi K. K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K.K.); and Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); and Nipol Lx416, LX410, LX430, LX435, LXi 10, LX415A, LX438C, 2507H, LX303A, LX407BP series, V1004, and MH5055 (trade names, manufactured by Nippon Zeon Co., Ltd.).

Examples of poly vinyl chlorides include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

Examples of the polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); and Zaikusen and Ceporjon G (trade names, manufactured by Sumitomo Seika Chemicals Co., Ltd.).

Examples of the copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C,A22J7-F2, 1128C, 1137, 1138,A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

These latex polymers may be used singly, or two or more of these polymers may be blended, if necessary.

In the present invention, at least one receptor layer is formed by coating a water-based coating liquid. In the case where a plurality of receptor layers is coated, it is more preferred that the receptor layers be formed by coating water-based coating liquids, followed by drying. The "water-based" or "aqueous" so-called herein means that 60% by mass or more of the solvent (dispersion medium) of the coating solution is water. As a component other than water in the coating solution, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

Preferable examples of the latex polymer for use in the present invention include polylactates, polyurethanes, polycarbonates, polyesters, polyacetals, and SBRs, and polyvinyl chlorides. Among these, polyesters, polycarbonates, and polyvinyl chlorides are preferable.

In the present invention, polyvinyl chlorides are preferred among the above-described latex polymer. Of these polyvinyl chlorides that are latex polymer containing at least a recurring unit obtained from vinyl chloride, preferred is a latex polymer containing a recurring unit obtained from vinyl chloride in an amount of 50 mole % or more based on the latex polymer, and more preferred is a copolymerized latex polymer. With respect to the copolymerized latex polymer, preferable monomers that polymerize with vinyl chloride are acrylic or methacrylic acid or esters thereof, vinyl acetate, and ethylene, more preferably acrylic or methacrylic acid or esters thereof, and still more preferably acrylic acid esters. The alcohol moiety that composes the ester group of the acrylic acid ester preferably has carbon atoms of from 1 to 10, and more preferably from 1 to 8.

As the polyvinyl chlorides, the above-described polymers may be used. Of the above-described polyvinyl chlorides, preferred are VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938, VINYBLAN 950, each of which is a product of Nissin Chemical Industry Co., Ltd.; SE1320 and S-830, each of which is a product of Sumitomo Chemtech.

In the present invention, latex polymers are used for reception of dyes transferred from an ink sheet, and they may be used in combination with any other polymers.

Polymers with which the latex polymers are used in combination, though may be used for reception of dyes, can also be used as binders for keeping of the latex polymers.

Preferred polymers are transparent or semitransparent, and generally colorless. Examples include natural resins, polymers and copolymers; synthetic resins, polymers, and copolymers; and other media that form films: for example, gelatins, polyvinyl alcohols, hydroxyethyl celluloses, cellulose acetates, cellulose acetate butylates, polyvinylpyrrolidones, caseins, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, and polyamides. The binder may be dissolved or dispersed in a water or in an organic solvent, or may be in the form of an emulsion.

When, besides the latex polymer used for reception of dyes transferred from an ink sheet, the above-mentioned binder is used, the glass transition temperature (Tg) of the latex polymer is preferably in the range of −30° C. to 70° C., more preferably −10° C. to 50° C., still more preferably 0° C. to 40° C., in view of film-forming properties (brittleness for working) and image preservability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) can be calculated according to the following equation:

$$1/Tg=\Sigma(Xi/Tgi)$$

wherein, assuming that the polymer is a copolymer composed of n monomer components from i=1 to i=n, Xi is a mass fraction of the i-th monomer ($\Sigma Xi=1$) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

Incidentally, although the glass transition temperatures of the latex polymers used in the present invention for reception of dyes and those of hollow polymers as described hereinafter are defined by measured values, they can also be estimated from the above calculating formula.

<Water-soluble Polymer>

In the present invention, the receptor layer preferably contains a water-soluble polymer.

Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The latex polymer refers to the state in which polymer fine particles are dispersed in a dispersion medium, so it is different from the water-soluble polymers usable in the present invention.

The water-soluble polymer which can be used in the present invention is any of natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention.

In the present invention, the water-soluble polymer is also referred to as a binder, for differentiation from the latex polymer described above.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Gelatin is one of preferable embodiments in the present invention. Gelatin having a molecular weight of from 10,000 to 1,000,000 may be used in the present invention. Gelatin that can be used in the present invention may contain an anion such as $Cl^-$ and $So_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal atom) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Among the water-soluble synthetic polymers that can be used in the present invention, polyvinyl alcohols are preferable.

The polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; and L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, –SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid added is preferably 0.01 to 40 mass % with respect to polyvinyl alcohol.

In the present invention, latex polymers are used for reception of dyes transferred from an ink sheet, and they may be used in combination with any other polymers.

Polymers with which the latex polymers are used in combination, though may be used for reception of dyes, can also be used as binders for keeping of the latex polymers.

Preferred polymers are transparent or semitransparent, and generally colorless. Examples include natural resins, polymers and copolymers; synthetic resins, polymers, and copolymers; and other media that form films: for example, gelatins, polyvinyl alcohols, hydroxyethyl celluloses, cellulose acetates, cellulose acetate butylates, polyvinylpyrrolidones, caseins, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, and polyamides. The binder may be dissolved or dispersed in a water or in an organic solvent, or may be in the form of an emulsion.

In the present invention, preferred water-soluble polymers are polyvinyl alcohols and gelatin, with gelatin being most preferred.

The amount of the water-soluble polymer to be added to the receptor layer is preferably from 1 to 25% by mass, more preferably from 1 to 10% by mass, based on the entire mass of the receptor layer. Not using any water-soluble polymer is also a preferred embodiment of the present invention.

The polymer, other than the water-soluble polymer, that can be used as a binder in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer that can be used in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H (trade name) manufactured by Kao Corporation,) are still more preferable, and low electrolyte types such as PIONIN A-43-S (trade name, manufactured by Takemoto Oil & Fat Co., Ltd.) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer that can be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (—Complexane no Kagaku—) (EDTA—Chemistry of Complexane—)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,l-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties deteriorate.

In the preparation of the latex polymer that can be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 40 mass % or less of the entire solvent, more preferably 30 mass % or less of the entire solvent.

Furthermore, in the latex polymer for use in the present invention, the polymer concentration is, based on the amount of the latex liquid, preferably 10 mass % to 70 mass %, more preferably 20 mass % to 60 mass %, and especially preferably 30 mass % to 55 mass %.

The amount of the latex polymer to be added is preferably 50 to 95% by mass and more preferably 70 to 90% by mass as its solid content based on all polymers in the receptor layer.

The latex polymer in the image-receiving sheet according to the present invention includes a state of a gel or dried film formed by removing a part of solvents by drying after coating.

<Ultraviolet Absorber>

Also, in the present invention, in order to improve light resistance, an ultraviolet absorber may be added to the receptor layer. In this case, when this ultraviolet absorber is made to have a higher molecular mass, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No. 3450339 may be used. As the ultraviolet absorber to be used in a form of a latex, the following commercially available ultraviolet absorbers may be used which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the receptor latex polymer capable of being dyed to be used to form the receptor layer.

<Releasing Agent>

Also, a releasing agent may be compounded in the receptor layer, in order to prevent thermal fusion with the heat-sensitive transfer sheet when an image is formed. As the releasing agent, a silicone oil, a phosphate-based releasing agent, a fluorine-series compound, or various wax dispersions may be used, and the silicone oil and the wax dispersions are particularly preferably used.

As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable. As described above, the addition amount of the releasing agent should be determined also in taking other properties into consideration. The amount of the releasing agent is preferably approximately from 0.2 to 30 parts by mass, per 100 parts by mass of the receptor polymer.

As the wax dispersions, known dispersions may be used. In the present invention, "wax" means an organic compound having an alkyl chain which is in a solid or semisolid state at room temperature (according to the definition given in *Kaitei Wax no Seishitsu to Oyo* (Revised edition, Properties and Applications of Wax), Saiwai Shobo (1989)). Preferable examples of the organic compound include candelilla wax, carnauba wax, rice wax, haze wax, montan wax, ozokerite, paraffin wax, microcrystalline wax, petrolatum, Fischer-Tropsch wax, polyethylene wax, montan wax derivatives, paraffin wax derivatives, microcrystalline wax derivatives, hydrogenated ricinus, hydrogenated ricinus derivatives, 12-hydroxystearic acid, stearic acid amide, phthalic anhydride imide, chlorinated hydrocarbons, and other mixed waxes. Of these waxes, carnauba wax, montan wax and derivatives thereof, paraffin wax and derivatives thereof, microcrystalline wax and derivatives thereof, polyethylene wax and stearic acid amide are preferred; carnauba wax, montan wax and derivatives thereof, microcrystalline wax and stearic acid amide are more preferred; montan wax derivatives and microcrystalline wax are further preferred.

The wax is selected from wax having melting points of generally 25° C. to 120° C., preferably 40° C. to 100° C., more preferably 60° C. to 90° C.

<Emulsion>

Hydrophobic additives, such as an anti-color fading agent, an ultraviolet absorber, an antioxidant, a releasing agent, and the like, can be introduced into a layer of the image-receiving sheet (e.g. the receptor layer, the heat insulation layer, the intermediate layer, the undercoat layer), by using a known method described in U.S. Pat. No. 2,322,027, or the like. In this case, a high-boiling organic solvent, as described in U.S. Pat. No. 4,555,470, 4,536,466, 4,536,467, 4,587,206, 4,555,476 and 4,599,296, JP-B-3-62256, and the like, may be used singly or in combination with a low-boiling organic solvent having a boiling point of 50 to 160° C., according to the need. Also, these releasing agent, antioxidants, and high-boiling organic solvents may be respectively used in combination of two or more.

As the lubricant (releasing agent), solid wax such as polyethylene wax, amide wax and Teflon (registered trademark) powder; silicone oil, phosphate-series compounds, fluorine-based surfactants, silicone-based surfactants and others including releasing agents known in the technical fields concerned may be used. Various kinds of waxes, Fluorine-series compounds typified by fluorine-based surfactants, silicone-based surfactants and silicone-series compounds such as silicone oil and/or its hardened products are preferably used.

As the anti-color fading agent, there can be used A-6, 7, 20, 21, 23, 24, 25, 26, 30, 37, 40, 42, 48, 63, 90, 92, 94, 164 described in the specification (pp. 69 to 118) of European Patent Publication No. 298321A, II-1 to III-23, especially III-10 described in the specification (columns 25 to 38) of U.S. Pat. No. 5,122,444, I-1 to III-4 described in the specification (pp. 8 to 12) of European Patent Publication No. 471347A, A-1 to A-48, especially A-39, A-42 described in the specification (columns 32 to 40) of U.S. Pate. No. 5,139,931, and formulae (I) to (III) described in the specification (page 4, lines 30 to 33), especially I-47, I-72, III-1 and III-27 (pp. 24 to 48) of European Patent Publication No. 298321A.

<Surfactant>

Further in the heat-sensitive transfer image-receiving sheet of the present invention, a surfactant may be contained in any of such layers as described above. Of these layers, it is preferable to contain the surfactant in a receptor layer and an intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

Without any surfactant, a coating operation is possible. However, because surface tension of a coating liquid is high, a coated surface state sometimes becomes lack of uniformity, which results in unevenness. By containing a surfactant to a coating liquid, surface tension of the coating liquid reduces. Thereby unevenness at the time of coating is eliminated and a coated surface state is made uniform. Consequently, a coating operation can be performed stably.

BFS-1

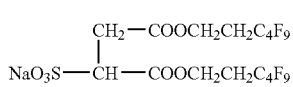

BFS-2

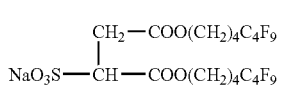

BFS-3

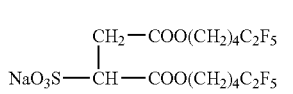

BFS-4

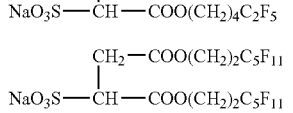

BFS-5

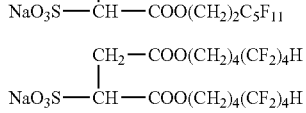

BFS-6

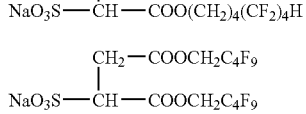

BFS-7

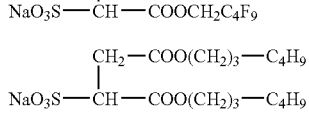

BFS-8

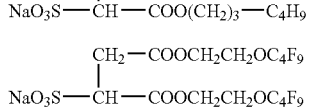

BFS-9

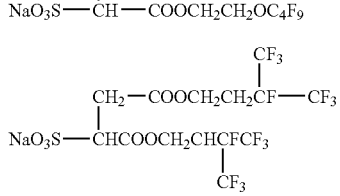

BFS-10

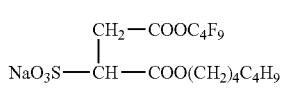

-continued

BFS-11

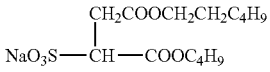

BFS-12

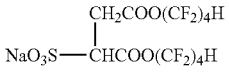

BFS-13

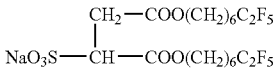

BFS-14

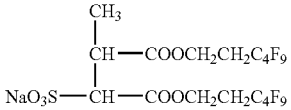

BFS-15

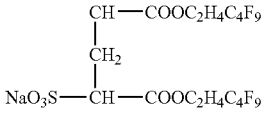

These fluorine compounds are used as a surfactant in coating compositions used to form layers (especially, a receptor layer, a heat insulation layer, an intermediate layer, a subbing layer, a back layer, etc.) by which a heat-sensitive transfer image-receiving sheet is composed. In the present invention, they are preferably contained in a receptor layer and an intermediate layer.

<Hardener>

As the crosslinking agent that can be used in the present invention, a hardener (hardening agent) may be added in coating layers (e.g., the receptor layer, the heat insulation layer, the undercoat layer) of the image-receiving sheet.

Preferable examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series hardening agent (formaldehyde, etc.), an aziridine-series hardening agent, an epoxy-series hardening agent, a vinyl sulfone-series hardening agent (N,N'-ethylene-bis(vinylsulfonylacetamido) ethane, etc.), an N-methylol-series hardening agent (dimethylol urea, etc.), a boric acid, a metaboric acid, or a polymer hardening agent (compounds described, for example, in JP-A-62-234157), can be mentioned.

Preferable examples of the hardener include a vinylsulfone-series hardener and chlorotriazines.

More preferable hardeners in the present invention are compounds represented by the following Formula (B) or (C).

$$(CH_2{=}CH{-}SO_2)_n\text{-}L \qquad \text{Formula (B)}$$

$$(X{-}CH_2{-}CH_2{-}SO_2)_n\text{-}L \qquad \text{Formula (C)}$$

In formulae (B) and (C), X represents a halogen atom, L represents an organic linking group having n-valency. When the compound represented by formula (B) or (C) is a low-molecular compound, n denotes an integer from 1 to 4. When the compound represented by formula (B) or (C) is a high-molecular (polymer) compound, L represents an organic linking group containing a polymer chain and n denotes an integer ranging from 10 to 1,000.

In the Formulae (B) and (C), X is preferably a chlorine atom or a bromine atom, and further preferably a bromine atom. n is an integer from 1 to 4, preferably an integer from 2 to 4, more preferably 2 or 3 and most preferably 2.

L represents an organic group having n-valency, and preferably an aliphatic hydrocarbon group, an aromatic hydrocarbon group or a heterocyclic group, provided that these groups may be combined through an ether bond, ester bond, amide bond, sulfonamide bond, urea bond, urethane bond or the like. Also, each of these groups may be further substituted. Examples of the substituent include a halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamide group, carbamoyl group, sulfamoyl group, sulfonyl group, phosphoryl group, carboxyl group and sulfo group. Among these groups, a halogen atom, alkyl group, hydroxy group, alkoxy group, aryloxy group and acyloxy group are preferable.

These hardeners are preferably used in an amount of 0.001 to 1 g, and further preferably 0.005 to 0.5 g, per 1 g of the water-soluble polymer.

<Antiseptic>

If a coating liquid, an image-receiving sheet, a print image and the like are reserved, microorganism (especially, bacteria, mold, yeast, etc.) attaches to these materials during reservation, thereby to reduce their capacities in many cases. In order to prevent from reduction in the capacity, an antiseptic may be contained in the coating liquid and the like in such a degree that other capacities are not adversely affected by the antiseptics.

The term "antiseptic" used in the present invention means a compound that is used to prevent a compound for use in the image-receiving sheet from being subjected to decomposition reaction caused by growth of microorganism. Representation by formula and specific compounds are described in, for example, "Boufu Boukabi Handobukku (Hand book of antiseptic treatment and fungusproofing)", Gihoudo Shuppan (1986); "Boukin Boukabi no Kagaku (Chemistry of bacteria resistance and fungusproofing)", authored by Hiroshi Horiguchi, Sankyo Shuppan (1986); and "Boukin Boukabizai Jiten (Encyclopedia of bacteria resisting agents and fungusproofing agents)", published by Nippon Boukin Boukabi Gakkai (1986).

The antiseptic to be contained in the image-receiving sheet of the present invention are not particularly limited. Examples of the antiseptics include phenol or its derivatives, formalin, imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, 2-mercaptopyridine-N-oxide or its salt, and formaldehyde donor-series antibacterial agent. Of these antiseptics, materials such as phenol or its derivatives, 4-isothiazoline-3-on derivatives, and benzoisothiazoline-3-on are preferred.

Beside, compounds represented by any one of formulae (I) to (IV) set forth below may be used as antiseptics.

Formula [I]

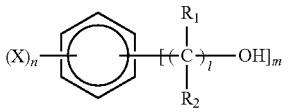

Formula [II]

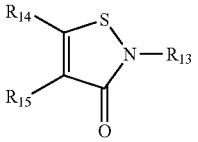

Formula [III]

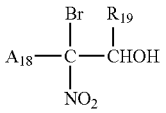

Formula [IV]

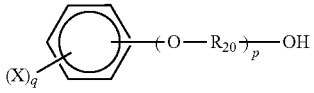

In formula (I), $R_1$ and $R_2$, which may be the same or different, each represent a hydrogen atom, a hydroxyl group, or a lower alkyl group. X represents a hydrogen atom, a halogen atom, a nitro atom, a cyano group, an aryl group, a lower alkyl group, a lower alkenyl group, an aralkyl group, an alkoxy group, —$COR_3$, —$SO_2R_4$, or —$N(R_5)R_6$.

$R_3$ and $R_4$ each represent a hydrogen atom, —OM, a lower alkyl group, a lower alkoxy group, or —$N(R_7)R_8$.

$R_5$ and $R_6$, which may be the same or different, each represents a hydrogen atom, a lower alkyl group, —$COR_9$, or —$SO_2R_{10}$. $R_9$ and $R_{10}$ each represent a lower alkyl group, or —$N(R_{11})R_{12}$. $R_7$, $R_8$, $R_{11}$ and $R_{12}$, which may be the same or different, each independently represents a hydrogen atom, or a lower alkyl group.

In formula (II), $R_{13}$ represents a hydrogen atom, an alkyl group, an alkenyl group, an aralkyl group, an aryl group, a heterocyclic group.

$R_{14}$ and $R_{15}$ each represent a hydrogen atom, a halogen atom, an alkyl group, an aryl group, a cyano group, a heterocyclic group, an alkylthio group, an alkylsulfoxyl group, or an alkylsulfonyl group. $R_{14}$ and $R_{15}$ may bond together to form an aromatic ring.

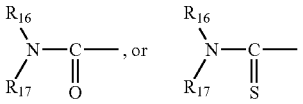

$R_{16}$ and $R_{17}$ each represent a hydrogen atom, an alkyl group, an aryl group, or an aralkyl group.

Of these compounds represented by formula (II), preferred is the compound in which $R_{14}$ and $R_{15}$ are each a hydrogen atom and $R_{13}$ is a methyl group. Hereinafter, said specific compound is designated as Compound II-a. It is more preferred to combine Compound II-a and the compound in which $R_{14}$ and $R_{15}$ bond together to form an aromatic ring and $R_{13}$ is a methyl group, or alternatively to combine Compound II-a and the compound in which $R_{14}$ is a chlorine atom, $R_{15}$ is a hydrogen atom and $R_{13}$ is a methyl group.

In formula (III), $R_{18}$ represents a hydrogen atom, an alkyl group, or a hydroxymethyl group; and $R_{19}$ represents a hydrogen atom or an alkyl group.

In formula (IV), $R_{20}$ represents a lower alkylene group. X represents a hydrogen atom, a halogen atom, a nitro atom, a hydroxyl group, a cyano group, a lower alkyl group, a lower alkoxy group, —$COR_{21}$, —$N(R_{22})R_{23}$, or —$SO_3M$. $R_{21}$ represents a hydrogen atom, —OM, a lower alkyl group, an aryl group, an aralkyl group, a lower alkoxy group, an aryloxy group, an aralkyloxy group, or —$N(R_{24})R_{25}$.

$R_{22}$ and $R_{23}$, which may be the same or different, each represent a hydrogen atom, a lower alkyl group, an aryl group, an aralkyl group, —$COR_{26}$, or —$SO_2R_{26}$. $R_{24}$ and $R_{25}$, which may be the same or different, each represent a hydrogen atom, a lower alkyl group, an aryl group, or an aralkyl group. $R_{26}$ represents a lower alkyl group, an aryl group, or an aralkyl group. M represents a hydrogen atom, an alkali metal atom, or atoms necessary for forming a univalent cation. p represents 0 or 1. q represents 0 or an integer of from 1 to 5.

As the antiseptics, one kind material may be used alone. Alternatively, two or more kinds of arbitrary materials may be used in combination. The antiseptic may be added as it is, or may be added as a solution of the antiseptic dissolved in water or an organic solvent such as methanol, ethanol, isopropyl alcohol, acetone, ethylene, and ethylene glycol, to a coating liquid for the image-receiving sheet. Alternatively, the antiseptics may be added to latex. Beside, after dissolving antiseptics in a high boiling solvent or a low boiling solvent, or a mixture thereof, followed by emulsion dispersion in the presence of a surfactant, the resultant dispersion of the antiseptics may be added to latex.

<Matting Agent>

In the present invention, a matting agent is preferably contained for providing releasing property with the image-receiving sheet. The matting agent is preferably added to the outermost layer or the layer that functions as the outermost layer or a layer close to the outermost layer of the heat-sensitive transfer image-receiving sheet. The outermost layer may be composed of two layers, if necessary. Most preferably, the matting agent is added to the receptor layer disposed as the outermost layer. Besides, the matting agent may be added to the outermost layer on the same side as the image-forming side and/or the outermost layer at the back side. In the present invention, it is especially preferred that the matting agent is contained on the same side as the layer containing a sliding agent with respect to the support.

In the present invention, it is preferred that a matting agent is previously dispersed with a binder so that the matting agent can be used as a dispersion of matting agent particles.

In the present invention, examples of the matting agent generally include fine particles of water-insoluble organic compounds and fine particles of water-insoluble inorganic compounds. Organic compound-containing fine particles are preferably used from the viewpoints of dispersion properties. In so far as an organic compound is incorporated in the particles, there may be organic compound particles consisting of the organic compound alone, or alternatively organic/inorganic composite particles containing not only the organic compound but also an inorganic compound. As the matting agent, there can be used those materials well known in the field of silver halide photosensitive materials, such as organic matting agents described in, for example, U.S. Pat. Nos. 1,939,213, 2,701,245, 2,322,037, 3,262,782, 3,539,344, and 3,767,448.

It is preferred that the matting agent has a heat resistance because a surface temperature of the receptor layer becomes high at the time of graphic printing.

In the present invention, a preferable matting agent is composed of the polymer such as the above-described organic compounds, in which the polymer has a thermal decomposition temperature of 200° C. or more, more preferably 240° C. or more.

Besides, a hard matting agent is preferred because not only heat but also pressure is applied to the surface of the receptor layer at the time of graphic printing.

It is preferred that the matting agent preferably contained in the outermost layer and a layer adjacent to the outermost layer on the same side as an image-forming layer is previously dispersed with a binder and used as a dispersion of matting agent particles. As the method for dispersion, there are two methods, namely (a) a method of preparing dispersions of the matting agent, comprising the steps of preparing a solution of a polymer to be as a matting agent (for example, dissolving the polymer in a low boiling-point solvent), emulsifying and dispersing the solution in an aqueous medium to obtain droplets of the polymer, and then eliminating the low boiling-point solvent from the resultant emulsion, and (b) a method of preparing of dispersions, comprising the steps of previously preparing fine particles, including a polymer, to be as a matting agent, and then dispersing the fine particles in an aqueous medium while preventing from generation of aggregate. In the present invention, preferred is the method (b) that does not discharge such a low boiling-point solvent to environments from the environmental concern.

To the dispersions of the matting agent in the present invention, a surfactant is preferably added for stabilization of the dispersed state.

(Heat Insulation Layer)

In the present invention, the heat insulation layer serves to protect the support from heat when a thermal head or the like is used to carry out a transfer operation under heating. Also, because the heat insulation layer generally has proper cushion characteristics, a heat-sensitive transfer image-receiving sheet having high printing sensitivity can be obtained even in the case of using paper as a substrate (support). The heat insulation layer may be a single layer, or multi-layers. The heat insulation layer is generally arranged at a nearer location to the support than the receptor layer.

In the image-receiving sheet of the present invention, the heat insulation layer is preferably formed by a water-based coating method. Further, the heat insulation layer preferably contains a hollow polymer.

The hollow polymer particles in the present invention are polymer particles having independent pores inside of the particles, and are preferably a latex polymer. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

The particle size of the hollow polymer particles is preferably 0.3 to 1.0 μm. If the size is too small, a hollow rate tends to reduce, so that it becomes difficult to obtain a desired heat insulating property. On the other hand, if the size is too large, occurrence of the coated surface state troubles owing to components other than coarse particles in the heat insulation layer becomes frequent.

The hollow ratio (percentage of hollowness) of the hollow polymer particles is preferably in the range of from about 20% to about 70%, and more preferably from 20% to 50%. If the hollow rate is too small, it becomes difficult to obtain a desired heat insulating property. On the other hand, if the hollow rate is too large, a rate of both brittle hollow polymer particles and incomplete hollow particles increases. As a result, such problems arise that a print failure occurs and also satisfactory film strength can not be obtained.

If necessary, the hollow polymer may be used as a mixture of two or more kinds of the polymers. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer that is used in the heat insulation layer may be used in the form of a latex.

Thought there is no particular restriction, the glass transition temperature (Tg) of the hollow polymer particles is preferably 70° C. or more and more preferably 100° C. or more. These hollow polymer particles may be used in combinations of two or more of those, according to the need.

A water-dispersible resin or water-soluble type resin is preferably used, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, urethane resin, polyvinylidene chloride resin, cellulose derivative, casein, starch, and gelatin may be used. These are preferably a water-soluble polymer as described for the receptor layer. Among these binder resins, gelatin, a polyvinyl alcohol resin, a styrene/butadiene copolymer and a urethane resin are preferable; and gelatin and a polyvinyl alcohol resin are more preferable. Also, these resins may be used either singly or as a mixture thereof.

The solid content of the hollow polymer particles in the heat insulation layer preferably falls in a range from 5 to 2,000 parts by mass, assuming that the solid content of the binder resin be 100 parts by mass. Also, the ratio by mass of the solid content of the hollow polymer particles in the coating solution is preferably 1 to 70% by mass and more preferably 10 to 40% by mass. If the percentage of the hollow polymer is too low, it is difficult to obtain a satisfactory heat insulating property. On the other hand, if the percentage of the hollow polymer is too high, bonding capacities among hollow polymers decrease. As a result, reduction of the bonding capacity causes problems such as falling-off of powder and film peeling during processing.

The particle size of the hollow polymer particles is preferably 0.1 to 20 μm, more preferably 0.1 to 2 μm, further preferably 0.1 to 1 μm.

The amount of the binder in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

A thickness of the heat insulation layer containing the hollow polymer particles is preferably from 5 to 50 μm, more preferably from 5 to 40 μm.

(Intermediate Layer)

An intermediate layer may be formed between the receptor layer and the heat insulation layer. As the intermediate layer, for example, at least one of a white background controlling layer, a charge controlling layer, an adhesion layer, a primer layer, and an undercoat layer is formed. These layers may be formed in the same manner as those described in, for example, each specification of Japanese Patent Nos. 3585599 and 2925244.

(Support)

In the present invention, it is preferred to use a water-proof support as the support. The use of the waterproof support makes it possible to prevent the support from absorbing moisture, whereby a fluctuation in the performance of the receptor layer with the lapse of time can be prevented. As the waterproof support, for example, coated paper or laminate paper may be used. Especially, a laminated paper is preferred in terms of surface smoothness. It is suitable to use a similar article to a polyethylene laminated paper (this paper is sometimes abbreviated as a WP paper) that is used for a photographic printing paper in the field of silver salt photography, namely a paper composed of cellulose as a main component in which at least one surface of said paper at the same side as the receptor layer-coating side is laminated with a polyolefin resin.

Coated Paper

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper and the like. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

Laminated Paper

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment, such as titanium oxide, into the sheet or film, can be mentioned. The thus-processed paper is generally used as a support for a photographic printing paper in the field of silver salt photography. This paper is sometimes abbreviated as a WP paper.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

The method of producing the heat-sensitive transfer image-receiving sheet of the present invention is explained below.

The heat-sensitive transfer image-receiving sheet of the present invention is produced by coating at least one receptor layer and at least one heat insulation layer on a support with using a water-based coating liquid. The coating method can be properly selected from a known method to perform a coating operation.

The embodiments where both or one of the receptor layer and the heat insulation layer are composed of two or more layers are preferable. At least, if constitutional layers adjacent to each other are to be coated with using water-based coating liquids, it is preferred that these layers be coated according to a simultaneous multilayer coating method.

It is known that in the case of producing an image-receiving sheet composed of plural layers having different functions from each other (for example, an air cell layer, a heat insulation layer, an intermediate layer, and a receptor layer) on a support, it may be produced by applying each layer successively one by one, or by overlapping the layers each already coated on a support, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods, such as the so-called slide coating (slide coating method) and curtain coating (curtain coating method), as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al. and "Coating and Drying Defects: Troubleshooting Operating Problems", John Wiley & Sons, 1995, pp. 101-103. In these coating methods, a plurality of coating liquids is simultaneously fed to a coating apparatus to form different multi layers.

In the present invention, effects of the invention are successfully realized by using a simultaneous multilayer coating method to produce a multilayer image-receiving sheet. At the same time, it is possible to obtain a heat-sensitive transfer image-receiving sheet that is excellent in traveling (transport property) at the time when the image-receiving sheet is superposed on an ink sheet to make a print. Besides, it is also possible to obtain a heat-sensitive transfer image-receiving sheet that is excellent in adherence between coating layers, so that film peeling seldom arises even if the image-receiving sheet is repeatedly put on a notice board with an adhesive tape. In addition, productivity can be sharply improved.

In the simultaneous multilayer coating method, it is necessary to adjust both viscosity and surface tension of coating liquids used for forming layers in terms of uniform coating formation and good coating property. The viscosity of coating liquid can be easily adjusted using known thickeners or viscosity reducers in such a degree that they do not affect to other performances. Beside, the surface tension of coating liquid can be adjusted using various kinds of surfactants.

The plural layers in the present invention are structured using resins as their major components. Coating solutions for forming each layer are preferably polymer latexes. The solid content by mass of the resin put in a latex state in each layer coating solution is preferably in the range from 5 to 80% and particularly preferably 20 to 60%. The average particle size of the resin contained in the above polymer latex is preferably 5 μm or less and particularly preferably 1 μm or less. The above polymer latex may contain a known additive, such as a surfactant, a dispersant, and a binder resin, according to the need.

The temperature of these coating liquids is preferably in the range of from 25° C. to 60° C., and more preferably from 30° C. to 50° C.

In the present invention, it is preferred that a laminate composed of plural layers be formed on a support and solidified just after the forming, according to the method described in U.S. Pat. No.2,761,791. For example, in the case of solidifying a multilayer structure by using a resin, it is preferable to raise the temperature immediately after the plural layers are formed on the support. On the other hand, in the case where the layer contains a binder capable of gelling at a lower temperature as exemplified by gelatin, it is sometimes preferred that temperature is lowered promptly after forming multiple layers on a substrate so as to solidify the resultant coatings by cooling, and then the temperature is elevated to dry.

As an example of the method of lowering temperature, there is a method of blowing a cold air or the like to a coating. The temperature of cold air is preferably not more than 25° C., more preferably not more than 15° C., and especially preferably not more than 10° C. Beside, a period of time in which a coating is blued with a cold air varies depending on a traveling speed of the coating, but a preferable period of time is 15 seconds or more. In order to accelerate gelation, not only a ratio by mass of the binder is increased, but also a known gelling agent is used.

In the present invention, the coating amount of a coating solution per one layer constituting the multilayer structure is preferably in the range from 1 $g/m^2$ to 500 $g/m^2$. The number of layers in the multilayer structure may be arbitrarily selected from a number of 2 or more. The receptor layer is preferably provided as a layer most apart from the support.

The heat-sensitive transfer image-receiving sheet of the present invention is coated according to the above-described method, preferably a simultaneous multilayer coating method, and then dried. On account that latex is a main component of the coating liquid in the present invention, if the coating liquid is rapidly dried, shrinkage of the film caused by drying does not arise uniformly, so that crazing (cracking) becomes easy to arise in a coating after drying. For this reason, a slow drying is preferred.

In order to satisfy these requirements, it is necessary in the drying step to regulate a drying temperature, a dry air quantity, and a dew point of a dry air and to dry the coating while controlling a drying rate.

A heat-sensitive transfer sheet (an ink sheet) that is used in combination with the heat-sensitive transfer image-receiving sheet of the present invention as mentioned above, at the time of formation of a heat transfer image, is, for example, a sheet having on a support a dye layer containing a diffusion-transfer dye, and any ink sheet can be used as the sheet. As a means for providing heat energy in the thermal transfer, any of the known providing means may be used. For example, application of a heat energy of about 0 to 50 mJ/mm$^2$ by controlling the recording time in a recording device, such as a thermal printer (e.g., trade name: ASK-2000, manufactured by FUJIFILM Corporation), sufficiently attains the expected result.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable-type manuscript-making sheets, by appropriately selecting the type of support.

The present invention can be applied to a printer, a copying machine and the like, each of which uses a heat-sensitive transfer recording system.

The present invention enables to improve color reproduction so that a color image can be closely following original, and enables to obtain an image by a natural color reproduction that has been accomplished giving no feeling of unnaturalness.

The present invention will be described in more detail based on the following examples, but the invention is not intended to be limited thereto. In the following Examples, the terms "part" and "%" are values by mass, unless they are indicated differently in particular.

EXAMPLES (Preparation of Heat-Sensitive Transfer Image-Receiving Sheet)

An image-receiving sheet was prepared so as to have, on the support prepared in the foregoing manner, a subbing layer, a heat insulation layer, and a receptor layer, in increasing order of distance from the support. Compositions and application amounts of the coating solutions used herein are shown below.

All layers set forth below were simultaneously multilayer coated at a coating rate of 50 meters per min. The coating operation was performed by the above-described slide coating. After coating, the layers were passed through the 8° C. zone, and then dried by blowing a dry air of 28° C. and 40% RH.

| Coating solution for subbing layer (Composition) | |
|---|---|
| Styrene/butadiene latex (SR103 (trade name), manufactured by Nippon A & L Inc.) | 55 parts by mass |
| 6% Aqueous solution of polyvinyl alcohol (PVA) | 45 parts by mass |
| Aqueous 1% surfactant solution (BFS-1) | 2 parts by mass |
| NaOH for adjusting pH to 8 | |
| (Coating amount) | 14 ml/m$^2$ |

-continued

| Coating solution for heat insulation layer (Composition) | |
|---|---|
| Emulsified dispersion A | 30 parts by mass |
| Hollow latex polymer particles (MH5055 (trade name), manufactured by Zeon Corporation; Concentration of contained hollow particles: 30 wt %) | 42 parts by mass |
| Aqueous 10% gelatin solution | 25 parts by mass |
| Water | 3 parts by mass |
| Antiseptic (compound shown by formula n) | 0.2 parts by mass |
| NaOH for adjusting pH to 8 | |
| (Coating amount) | 55 ml/m$^2$ |

| Coating solution for receptor layer (Composition) | |
|---|---|
| Emulsified dispersion A | 4 parts by mass |
| Vinyl chloride-latex polymer (VINYBLAN 900 (trade name), manufactured by Nissin Chemical Industry Co., Ltd.) | 45 parts by mass |
| Vinyl chloride-latex polymer (VINYBLAN 276 (trade name), manufactured by Nissin Chemical Industry Co., Ltd.) | 18 parts by mass |
| Microcrystalline wax (EMUSTAR-42X (trade name), manufactured by Nippon Seiro Co., Ltd.) | 6 parts by mass |
| Water | 26 parts by mass |
| Aqueous 1% surfactant solution (BFS-1) | 4 parts by mass |
| Matting agent | 1 parts by mass |
| Antiseptic (compound shown by formula n) | 0.1 parts by mass |
| NaOH for adjusting pH to 8 | |
| (Coating amount) | 16 ml/m$^2$ |

(Preparation of Emulsified Dispersion of an Ani-color Fading Agent)

An emulsified dispersion A was prepared in the following manner. An ant-color fading agent EB-9 was dissolved in a mixture of 42 g of a high-boiling solvent (Solv-5) and 40 ml of ethyl acetate, and the resultant solution was emulsified and dispersed in 250 g of a 20-mass % aqueous gelatin solution containing 1 g of sodium dodecylbenzenesulfonate, by means of a high-speed stirring emulsifier (dissolver). Thereto, water was added, to prepare 380 g of the emulsified dispersion A.

(EB-9)

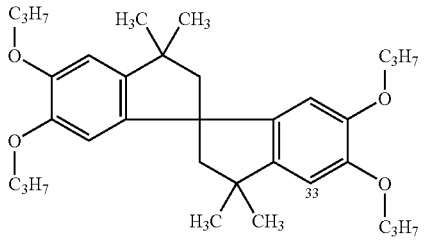

(Solv-5)

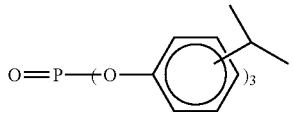

(Preparation of Heat-sensitive Transfer Sheet)

An heat-sensitive transfer sheet sample 101 was prepared by the following method.

A polyester film 6.0 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions were respectively applied as a monochromatic layer (coating amount: 1 g/m$^2$ after drying) on the front side of the film.

For evaluation, the thus-prepared heat-sensitive transfer sheet having each of yellow, magenta and cyan hues and a sheet having a coating of a transferable protective layer laminate described later were used by splice processing of them.

| Yellow composition | |
|---|---|
| Yellow dye Y2-6 | 2.8 parts by mass |
| Yellow dye Y1-7 | 2.7 parts by mass |
| Polyvinylbutyral resin (trade name: DENKA BUTYRAL #6000AR, manufactured by DENKI KAGAKU KOGYOU K. K.) | 4.5 parts by mass |
| Methyl ethyl ketone/toluene (1/1, at mass ratio) | 90 parts by mass |
| **Magenta composition** | |
| Magenta dye M-2 | 1.4 parts by mass |
| Magenta dye M2-1 | 0.6 parts by mass |
| Magenta dye M2-3 | 3.5 parts by mass |
| Polyvinylbutyral resin (trade name: DENKA BUTYRAL #6000AR, manufactured by DENKI KAGAKU KOGYOU K. K.) | 4.5 parts by mass |
| Methyl ethyl ketone/toluene (1/1, at mass ratio) | 90 parts by mass |
| **Cyan composition** | |
| Cyan dye C1-3 | 1.8 parts by mass |
| Cyan dye C2-2 | 3.7 parts by mass |
| Polyvinylbutyral resin (trade name: DENKA BUTYRAL #6000AR, manufactured by DENKI KAGAKU KOGYOU K. K.) | 4.5 parts by mass |
| Methyl ethyl ketone/toluene (1/1, at mass ratio) | 90 parts by mass |

(Preparation of Protective Layer Sheet)

A transferable protective layer laminate sheet was prepared by coating a releasing layer, a protective layer and an adhesion layer each having the composition shown below on the same polyethyleneterephthalate film as the film that was used to prepare the heat-sensitive transfer sheet. A dry coating amount of each of the releasing layer, the protective layer and the adhesion layer was controlled so as to become 0.1 g/m$^2$, 1 g/m$^2$ and 0.7 g/m$^2$, respectively. In this time, the protective layer was coated after the releasing layer was coated and dried. Further, the adhesion layer was coated after the protective layer was coated and dried.

| Releasing layer | |
|---|---|
| Diacetylcellulose (L-30 (trade name), manufactured by DAICEL CHEMICAL INDUSTRIES, LTD.) | 5.0 parts by mass |
| Methyl ethyl ketone | 95.0 parts by mass |
| **Protective layer** | |
| Acrylic resin (DIANAL BR-80 (trade name), manufactured by Mitsubishi Rayon) | 19.6 parts by mass |
| Methyl ethyl ketone/toluene (1/1, at mass ratio) | 80 parts by mass |
| Ultraviolet absorber (TINUVIN 900 (trade name), manufactured by Ciba-Geigy) | 0.4 parts by mass |
| **Adhesion layer** | |
| Acrylic resin (Vylon 220 (trade name), manufactured by Toyobo Co., Ltd.) | 30 parts by mass |
| Methyl ethyl ketone/toluene (1/1, at mass ratio) | 70 parts by mass |

(Preparation of Samples 102 to 110)

Heat-sensitive transfer sheets (samples 102 to 110) were prepared in the same manner as sample 101 prepared by the above-described method, except that cyan dye C2-2 was added to the magenta composition in an amount as set forth below, while an amount of the magenta dyes M-2, M2-1, and M2-3 was reduced.

In this time, only the increased amount due to addition of the cyan dye C2-2 was diminished from the amount of the magenta dyes M-2, M2-1, and M2-3 without changing the content ratio of these three dyes, so that a total content of dyes became the same as sample 101.

TABLE 1

| Sample No. | Content of Cyan dye C2-2 in Magenta composition (parts by mass) |
|---|---|
| Sample 101 | — |
| Sample 102 | 0.06 |
| Sample 103 | 0.08 |
| Sample 104 | 0.11 |
| Sample 105 | 0.17 |
| Sample 106 | 0.28 |
| Sample 107 | 0.39 |
| Sample 108 | 0.55 |
| Sample 109 | 0.72 |
| Sample 110 | 0.83 |

(Image Formation)

An image with a size of 152 mm×102 mm was output using the above-described ink sheet, protective layer sheet, and image-receiving sheet, by means of a thermal transfer type printer (ASK 2000, manufactured by FUJIFILM Corporation). Herein, a traveling rate was 73 mm/second.

(Evaluation of Color Reproduction)

Five sheets of print on which a macbeth chart of 24 colors was photographed were output. The thus-copied prints were evaluated according to the following five grades. The evaluation was each performed by 20 assessors. The average value of their scores was calculated.

1: There is a very strong feeling of unnaturalness in color reproduction of the prints.
2: There is a strong feeling of unnaturalness in color reproduction of the prints.
3: There is a feeling of unnaturalness in color reproduction of the prints, but the feeling is an allowable level.
4: Almost no feeling of unnaturalness is recognized in color reproduction of the prints.
5: No feeling of unnaturalness is recognized, and therefore color reproduction of the prints is excellent.

Further, a magenta monochromatic color wedge image was printed. Then, colorimetry of L*, a* and b* was performed to obtain E value according to the above-described formula.

Using samples 101 to 110, 11 points of stepwise images were produced in the region of L* value ranging from 40 to 95. Then, a* and b* were measured by colorimetry at each of the L* values to calculate E values according to equation (1). Based on the thus-obtained results, E values at the ordinate axis were plotted against L* values at the horizontal axis. The maximum of the E values in the region of L* value ranging from 45 to 90 (45≦L* value≦90) was measured with respect to each of the samples 101 to 110.

The results of evaluation are shown in Table 2.

TABLE 2

| Sample No. | Content of Cyan dye (C2-2) in Magenta dye (mass %) | Maximum of the E values in the region of L* value ranging from 45 to 90 | Color reproduction |
|---|---|---|---|
| Sample 101 (Comparative example) | 0 | 79.0 | 3.3 |
| Sample 102 (Comparative example) | 1.1 | 75.0 | 3.6 |

TABLE 2-continued

| Sample No. | Content of Cyan dye (C2-2) in Magenta dye (mass %) | Maximum of the E values in the region of L* value ranging from 45 to 90 | Color reproduction |
|---|---|---|---|
| Sample 103 (Comparative example) | 1.5 | 73.6 | 3.6 |
| Sample 104 (This invention) | 2.1 | 71.5 | 4.3 |
| Sample 105 (This invention) | 3.1 | 67.8 | 4.5 |
| Sample 106 (This invention) | 5.1 | 63.0 | 4.5 |
| Sample 107 (This invention) | 7.1 | 57.5 | 4.5 |
| Sample 108 (This invention) | 10.0 | 53.3 | 4.2 |
| Sample 109 (Comparative example) | 13.1 | 49.2 | 3.4 |
| Sample 110 (Comparative example) | 15.1 | 46.0 | 2.2 |

As is apparent from Table 2, as compared with Comparative examples 101 to 103 and 109 to 110, it is found that each of samples 104 to 108 of this invention is evaluated to have a high score, to thereby accomplish no feeling of unnaturalness in color reproduction, so that samples 104 to 108 of this invention are preferable.

Having described our invention as related to the present embodiments, it is our intention that the invention not be limited by any of the details of the description, unless otherwise specified, but rather be construed broadly within its spirit and scope as set out in the accompanying claims.

What we claim is:

1. An heat-sensitive transfer image-forming method which uses a heat-sensitive transfer image-receiving sheet and a heat-sensitive transfer sheet, in which the heat-sensitive transfer image-receiving sheet comprises at least one receptor layer; and the heat-sensitive transfer sheet comprises at least one yellow dye layer, at least one magenta dye layer, and at least one cyan dye layer:

comprising superposing the heat-sensitive transfer sheet on the heat-sensitive transfer image-receiving sheet, and then heating to form an image on the receptor layer; and comprising controlling the maximum value of E value represented by formula (1) having the range from 52 to 72, based on a* value and b* value in the region of L* value of the formed magenta monochromatic image ranging from 45 to 90

$$E=\sqrt{(a^{*2}+b^{*2})} \qquad \text{Formula (1).}$$

2. The heat-sensitive transfer image-forming method as described in claim 1, wherein the magenta dye layer contains at least one cyan dye in a content of 2% by mass to 10% by mass.

3. The heat-sensitive transfer image-forming method as described in claim 2, wherein the magenta dye layer contains at least one magenta dye represented by formula (M) and the cyan dye is a cyan dye represented by formula (C1):

Formula (M)

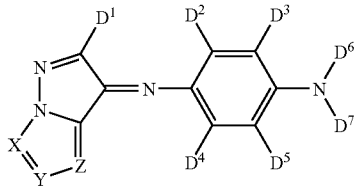

wherein, in formula (M), $D^1$, $D^2$, $D^3$ $D^4$, and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$-or a nitrogen atom, in which $D^8$ represents a hydrogen atom, an alkyl group, an aryl group, an alkoxy group, an aryloxy group, or an amino group; when X and Y each represent $=C(D^8)$-or Y and Z each represent $=C(D^8)$-, two $D^8$s may be bonded together to form a saturated or unsaturated carbon ring; and each of the above-mentioned groups may further be substituted, and Formula (C1)

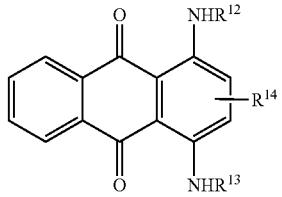

wherein, in formula (C1), $R^{12}$ and $R^{13}$ each independently represent a substituted or unsubstituted alkyl group or a substituted or unsubstituted aryl group; and $R^{14}$ represents a hydrogen atom or a substituent.

4. The heat-sensitive transfer image-forming method as described in claim 2, wherein the magenta dye layer contains at least one magenta dye represented by formula (M) and the cyan dye is a cyan dye represented by formula (C2):

Formula (M)

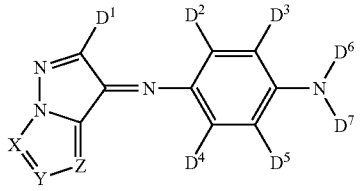

wherein, in formula (M), $D^1$, $D^2$, $D^3$ $D^4$, and $D^5$ each independently represent a hydrogen atom, a halogen atom, an alkyl group, an alkoxy group, an aryl group, an aryloxy group, a cyano group, an acylamino group, a sulfonylamino group, a ureido group, an alkoxycarbonylamino group, an alkylthio group, an arylthio group, an alkoxycarbonyl group, a carbamoyl group, a sulfamoyl group, a sulfonyl group, an acyl group, or an amino group; $D^6$ and $D^7$ each independently represent a hydrogen atom, an alkyl group, alkylcyano group or an aryl group; $D^6$ and $D^7$ may be bonded together to form a ring; $D^3$ and $D^6$ and/or $D^5$ and $D^7$ may be bonded together to form a ring; X, Y, and Z each independently represent $=C(D^8)$-or a nitrogen atom, in which $D^8$ represents a hydrogen atom, an alkyl group, an aryl group, an alkoxy group, an aryloxy group, or an amino group; when X and Y each represent $=C(D^8)$-or Y and Z each represent $=C(D^8)$-, two $D^8$s may be bonded together to form a saturated or unsaturated carbon ring; and each of the above-mentioned groups may further be substituted, and Formula (C2)

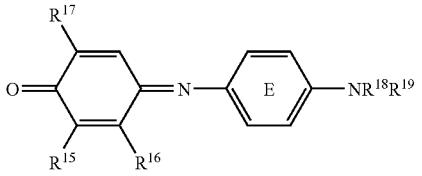

wherein, in formula (C2), the ring E represents a substituted or unsubstituted benzene ring; $R^{15}$ represents a hydrogen atom or a halogen atom; $R^{16}$ represents a substituted or unsubstituted alkyl group; $R^{17}$ represents a substituted or unsubstituted acylamino group or a substituted or unsubstituted alkoxycarbonylamino group; and $R^{18}$ and $R^{19}$ each independently represent a substituted or unsubstituted alkyl group, a substituted or unsubstituted alkenyl group, or a substituted or unsubstituted aryl group.

* * * * *